US008997650B2

(12) United States Patent
Nakamura et al.

(10) Patent No.: US 8,997,650 B2
(45) Date of Patent: Apr. 7, 2015

(54) INK SUPPLY METHOD AND INK SUPPLY APPARATUS

(71) Applicants: Akihiro Nakamura, Ibaraki (JP); Masahiro Hirano, Ibaraki (JP)

(72) Inventors: Akihiro Nakamura, Ibaraki (JP); Masahiro Hirano, Ibaraki (JP)

(73) Assignee: Komori Corporation, Tokyo (JP)

( * ) Notice: Subject to any disclaimer, the term of this patent is extended or adjusted under 35 U.S.C. 154(b) by 71 days.

(21) Appl. No.: 13/870,944

(22) Filed: Apr. 25, 2013

(65) Prior Publication Data

US 2013/0305941 A1 Nov. 21, 2013

(30) Foreign Application Priority Data

Apr. 26, 2012 (JP) ..... 2012-100638

(51) Int. Cl.
*B41F 31/30* (2006.01)
*B41F 31/04* (2006.01)

(52) U.S. Cl.
CPC ..... *B41F 31/04* (2013.01); *B41P 2233/11* (2013.01); *B41F 31/308* (2013.01)

(58) Field of Classification Search
CPC .... B41P 2233/11; B41F 31/308; B41F 31/04; B41F 31/12; B41F 31/10; B41F 31/301; B41F 31/302; B41F 31/30; B41F 31/045
USPC ..... 101/484, 351.3, 351.1, 351.2, 351.4, 101/352.04, 352.01, 352.02, 352.03, 352.05
See application file for complete search history.

(56) References Cited

U.S. PATENT DOCUMENTS

| | | | | |
|---|---|---|---|---|
| 4,520,729 | A | 6/1985 | Fischer | |
| 5,170,706 | A * | 12/1992 | Rodi et al. | 101/148 |
| 5,293,819 | A | 3/1994 | Fukuda | |
| 6,367,385 | B2 * | 4/2002 | Komori | 101/484 |
| 6,712,002 | B2 * | 3/2004 | Herbst et al. | 101/351.1 |
| 2008/0105148 | A1 | 5/2008 | Kusaka et al. | |
| 2008/0314270 | A1 * | 12/2008 | Kusaka et al. | 101/367 |

FOREIGN PATENT DOCUMENTS

| | | | |
|---|---|---|---|
| CN | 1030049 | C | 10/1995 |
| CN | 101172414 | A | 5/2008 |
| DE | 1561100 | | 2/1970 |
| EP | 2567818 | | 3/2013 |
| FR | 716863 | | 12/1931 |
| GB | 1516450 | | 7/1978 |
| JP | S58-201008 | A | 11/1983 |
| JP | S58-201010 | A | 11/1983 |

(Continued)

*Primary Examiner* — Daniel J Colilla
*Assistant Examiner* — Leo T Hinze
(74) *Attorney, Agent, or Firm* — Blakely Sokoloff Taylor & Zafman

(57) ABSTRACT

An ink supply method in an ink supply apparatus including an ink fountain, a plurality of ink fountain keys, an ink fountain roller, an ink ductor roller, and an ink roller group. An ink film thickness distribution corresponding to an image on a printing plate is formed in the ink roller group. The ink roller group is divided into a plurality of roller subgroups. After or before division, a throw-on operation is performed for at least one of the plurality of roller subgroups, and a plate cylinder on which the printing plate to be used for printing of the next job is mounted. Ink in at least one of the plurality of roller subgroups is supplied to the printing plate mounted on the plate cylinder by rotating the plate cylinder and at least one of the plurality of roller subgroups. An ink supply apparatus is also disclosed.

3 Claims, 23 Drawing Sheets

(56) References Cited

FOREIGN PATENT DOCUMENTS

| | | | |
|---|---|---|---|
| JP | H03-097564 | A | 4/1991 |
| JP | 07-096600 | A | 4/1995 |
| JP | H10-016193 | A | 1/1998 |
| JP | H11-188844 | A | 7/1999 |
| JP | 2013-059878 | A | 4/2013 |
| JP | 2013-059879 | A | 4/2013 |

* cited by examiner

Mc
Md
Md1
Md1
Md2
Me
MeA
MeB
MeA
MeB
MeA
MeB'
MeA
MeB'
Mf
INK ROLLER GROUP
PLATE CYLINDER/ BLANKET CYLINDER
INK REMOVING
THROW-OFF
PLATE REPLACEMENT/ CLEANING
PRE-INKING IN INK APPARATUS
DIVISION
THROW-ON
PLATE CYLINDER/ BLANKET CYLINDER PRE-INKING
COUPLING

Mc
Md
Md1
Md1
Me
Me
Me'
Mf
INK ROLLER GROUP
PLATE CYLINDER/ BLANKET CYLINDER
INK REMOVING
THROW-OFF
Md2
PLATE REPLACEMENT/ CLEANING
PRE-INKING IN INK APPARATUS
THROW-ON
PLATE CYLINDER/ BLANKET CYLINDER PRE-INKING

Mc
Md
Md1
Md1
Md2
Me
Me
Me
MeA
MeB
MeA
MeB'
MeA
MeB'
Mf
INK ROLLER GROUP
PLATE CYLINDER/ BLANKET CYLINDER
INK REMOVING
THROW-OFF
PLATE REPLACEMENT/ CLEANING
PRE-INKING IN INK APPARATUS
THROW-ON
DIVISION
COUPLING
PLATE CYLINDER/ BLANKET CYLINDER PRE-INKING

INK SUPPLY METHOD AND INK SUPPLY APPARATUS

BACKGROUND OF THE INVENTION

The present invention relates to an ink supply method and apparatus for supplying ink supplied to an ink fountain roller to a printing plate mounted on a plate cylinder via an ink roller group by the ink feed operation of an ink ductor roller.

FIG. 14 shows the main part of an inker (ink supply apparatus) in a printing unit of each color in a web offset printing press. In FIG. 14, the inker includes an ink fountain 1, an ink 2 stored in the ink fountain 1, an ink fountain roller 3, a plurality of ink fountain keys 4 (4-1 to **4-*n*) juxtaposed in the axial direction of the ink fountain roller 3, an ink ductor roller 5, an ink roller group 6, a printing plate 7, a plate cylinder 8 on which the printing plate 7 is mounted, a blanket cylinder 9, and an impression cylinder 50**.

In the ink supply apparatus, the ink 2 in the ink fountain 1 is supplied to the ink fountain roller 3 by adjusting the opening degrees of the ink fountain keys 4-1 to **4-*n*. The ink supplied to the ink fountain roller 3 is supplied to the printing plate 7 via the ink roller group 6 by the ink feed operation of the ink ductor roller 5**.

An image is printed on the printing plate 7. The blanket cylinder 9 receives the ink supplied to the printing plate 7, and the ink received by the blanket cylinder 9 is transferred to a printing sheet (member to be printed) 51 fed between the blanket cylinder 9 and the impression cylinder 50.

Note that ink form rollers 6-1 to 6-4 in contact with the printing plate 7 are arranged at the end of the ink flow path of the ink roller group 6. Dampening water stored in a water pan 53 is supplied to the printing plate 7 via a dampening form roller 52 together with the ink via the ink form rollers 6-1 to 6-4.

When switching a print job in the ink supply apparatus, that is, when replacing the printing plate 7 for a preceding print job with a printing plate 7' for the next print job, the opening degrees of the ink fountain keys 4-1 to **4-*n*, the rotation amount of the ink fountain roller 3, and the like are changed to values corresponding to an image on the printing plate 7' for the next print job. The ink 2 in the ink fountain 1 is supplied to the replaced printing plate 7' via the ink roller group 6. In this case, test printing is performed before final printing to adjust the ink supply amount, obtaining a satisfactory color tone. As a result, a desired ink film thickness distribution (gradient of the ink film thickness) is formed in the ink roller group 6 and on the plate cylinder 8 and blanket cylinder 9**.

However, in a conventional ink supply apparatus, when the printing plate 7 is replaced with the printing plate 7' to execute the next print job, an ink film thickness distribution corresponding to the printing plate 7 for the preceding print job remains in the ink roller group 6. In this case, the ink film thickness distribution corresponding to the printing plate 7 for the preceding print job needs to be gradually changed to an ink film thickness distribution corresponding to the printing plate 7' for the next print job. Adjustment of the ink supply amount and test printing are required excessively until a satisfactory color tone is obtained. This causes problems such as "increase in pre-printing preparation time", "increase in work load", "waste of printing materials", "decrease in production efficiency", and "increase in cost".

To reduce adjustment of the ink supply amount and the test printing count until a satisfactory color tone is obtained, there have been proposed "ink film thickness control methods" disclosed in Japanese Patent Laid-Open No. 10-16193 (patent literature 1) and Japanese Patent Laid-Open No. 11-188844 (patent literature 2).

[Ink-Decrease+Pre-Inking 2]

In the ink film thickness control method described in literature 1, when switching a print job, the ink feed operation of the ink ductor roller 5 is stopped. While the printing plate 7 for the preceding print job remains mounted, the printing press is operated to print a predetermined number of sheets (blank sheet printing), decreasing ink in the ink supply apparatus (ink-decrease). A minimum ink film thickness distribution Ma (see FIG. 15A) which thins from the upstream side to downstream side of the ink roller group 6 and is required during printing, that is, an ink film thickness distribution Ma corresponding to an image-free portion of the printing plate 7 remains (ink removing).

Then, the opening degrees of the ink fountain keys 4-1 to **4-*n*, the rotation amount of the ink fountain roller 3, and the like are set to values corresponding to an image on the printing plate 7' for the next print job. While the ink form rollers 6-1 to 6-4 are thrown off, the printing press is operated to perform the ink feed operation of the ink ductor roller 5 by a predetermined number of times. An ink film thickness distribution Mb (see FIG. 15B) corresponding to the image on the printing plate 7' for the next print job is superposed on the minimum ink film thickness distribution Ma which remains in the ink roller group 6 and is required during printing (pre-inking 2**).

[Ink Return to Fountain+Pre-Inking 1]

In the ink film thickness control method described in literature 2, when switching a print job, the opening ratios of the ink fountain keys 4-1 to **4-*n* are set to 0. In this state, the ink feed operation of the ink ductor roller 5 is performed by a predetermined number of times, returning all ink remaining in the ink roller group 6 to the ink fountain 1 (ink return to fountain). As a result, each roller in the ink roller group 6** does not hold any ink.

The opening degrees of the ink fountain keys 4-1 to **4-*n* are set to a predetermined value (e.g., 50%), and the rotation amount of the ink fountain roller 3 is set to a predetermined value (e.g., 50%). Then, the ink feed operation of the ink ductor roller 5 is performed by a predetermined number of times, forming a minimum ink film thickness distribution Ma (see FIG. 15A) required during printing in the ink roller group 6 (first step of pre-inking 1**).

The opening degrees of the ink fountain keys 4-1 to **4-*n*, the rotation amount of the ink fountain roller 3, and the like are set to values corresponding to the image on the printing plate 7' for the next print job. While the ink form rollers 6-1 to 6-4 are thrown off, the printing press is operated to perform the ink feed operation of the ink ductor roller 5 by a predetermined number of times. An ink film thickness distribution Mb (see FIG. 15B) corresponding to the image on the printing plate 7' for the next print job is superposed on the minimum ink film thickness distribution Ma which is formed in the ink roller group 6 and required during printing (second step of pre-inking 1**).

However, the ink film thickness control method described in patent literature 1 (ink-decrease+pre-inking 2) and the ink film thickness control method described in patent literature 2 (ink return to fountain+pre-inking 1), the ink film thickness distribution Mb corresponding to the image on the printing plate 7' for the next print job is superposed on the minimum ink film thickness distribution Ma which is formed in the ink roller group 6 and required during printing. Then, the ink form rollers 6-1 to 6-4 are thrown on, and printing starts by supplying ink in the ink roller group 6 to the replaced printing plate 7' for the next print job and the cleaned blanket cylinder 9. Printing for the next print job starts from a state in which no ink exists on the plate cylinder 8 and blanket cylinder 9. No normal printing product is obtained until an ink film thickness distribution in final printing is formed on the plate cylinder 8, blanket cylinder 9, and ink roller group 6 during printing. Many sheets are wasted, wasting printing materials.

It is also possible to superpose the ink film thickness distribution Mb corresponding to the image on the printing plate 7' for the next print job on the minimum ink film thickness distribution Ma which is formed in the ink roller group 6 and required during printing, then bring the ink form rollers 6-1 to 6-4, dampening form roller 52, plate cylinder 8, and blanket cylinder 9 into contact with each other before the start of printing the next job, rotate the printing press by a predetermined number of times, and supply ink to even the plate cylinder 8 and blanket cylinder 9 (see Japanese Patent Laid-Open No. 3-97564 (patent literature 3)). In this case, however, all ink in the ink supply apparatus is leveled by the ink roller group 6, plate cylinder 8, and blanket cylinder 9. Thus, an excessively large amount of ink is supplied to the plate cylinder 8 and blanket cylinder 9, and the ink film thickness distribution on the plate cylinder 8 and blanket cylinder 9 becomes excessively thick. As a result, many sheets are wasted until the excessively large amount of supplied ink is consumed.

SUMMARY OF THE INVENTION

The present invention has as its object to provide an ink supply method and apparatus capable of obtaining a normal printing product in a short time after a printing plate is replaced and printing of the next job starts.

In order to achieve the above-described object, according to the present invention, there is provided an ink supply method in an ink supply apparatus including an ink fountain storing an ink, a plurality of ink fountain keys arranged in the ink fountain, an ink fountain roller to which the ink is supplied from the ink fountain in accordance with opening ratios of the plurality of ink fountain keys, an ink ductor roller to which the ink is transferred from the ink fountain roller by an ink feed operation, and an ink roller group to which the ink transferred to the ink ductor roller is supplied, comprising the steps of forming, in the ink roller group, an ink film thickness distribution corresponding to an image on a printing plate for printing of a next job, dividing, into a plurality of roller subgroups, the ink roller group in which the ink film thickness distribution to be used for printing of the next job is formed, performing, after or before division, a throw-on operation for at least one of the plurality of roller subgroups including a most downstream roller subgroup, and a plate cylinder on which the printing plate to be used for printing of the next job is mounted, and supplying ink in at least one of the plurality of roller subgroups to the printing plate mounted on the plate cylinder by rotating by a predetermined number of times the plate cylinder and at least one of the plurality of roller subgroups, which are thrown on.

According to the present invention, there is provided an ink supply apparatus including an ink fountain storing an ink, a plurality of ink fountain keys arranged in the ink fountain, an ink fountain roller to which the ink is supplied from the ink fountain in accordance with opening ratios of the plurality of ink fountain keys, an ink ductor roller to which the ink is transferred from the ink fountain roller by an ink feed operation, and an ink roller group to which the ink transferred to the ink ductor roller is supplied, comprising ink film thickness distribution forming means for forming, in the ink roller group, an ink film thickness distribution corresponding to an image on a printing plate for printing of a next job, division means for dividing, into a plurality of roller subgroups, the ink roller group in which the ink film thickness distribution forming means forms the ink film thickness distribution to be used for printing of the next job, throw-on means for performing, after or before division by the division means, a throw-on operation for at least one of the plurality of roller subgroups including a most downstream roller subgroup, and a plate cylinder on which the printing plate to be used for printing of the next job is mounted, and ink supply means for supplying ink in at least one of the plurality of roller subgroups to the printing plate mounted on the plate cylinder by rotating by a predetermined number of times the plate cylinder and at least one of the plurality of roller subgroups, which are thrown on by the throw-on means.

In the present invention, an ink film thickness distribution corresponding to an image on a printing plate to be used for printing of the next job is formed in the ink roller group. The ink roller group in which the ink film thickness distribution corresponding to the image on the printing plate to be used for printing of the next job is formed is divided into a plurality of roller subgroups. After or before the division, at least the most downstream roller subgroup out of the plurality of roller subgroups, and the plate cylinder on which the printing plate to be used for printing of the next job is mounted are thrown on. That is, after division into a plurality of roller subgroups, at least the most downstream roller subgroup out of the divided roller subgroups, and the plate cylinder are thrown on. Alternately, after at least the most downstream roller subgroup out of a plurality of roller subgroups, and the plate cylinder are thrown on, the ink roller group is divided into a plurality of roller subgroups. The plate cylinder and the divided roller subgroup, which are thrown on, are rotated by a predetermined number of times, and ink in the roller subgroup is supplied to the printing plate mounted on the plate cylinder.

According to the present invention, the ink roller group in which an ink film thickness distribution corresponding to an image on a printing plate to be used for printing of the next job is formed is divided into a plurality of roller subgroups. After or before the division, at least the most downstream roller subgroup out of the plurality of roller subgroups, and the plate cylinder on which the printing plate to be used for printing of the next job is mounted are thrown on. The plate cylinder and the divided roller subgroup, which are thrown on, are rotated by a predetermined number of times, and ink in the roller subgroup is supplied to the printing plate mounted on the plate cylinder. For example, when the ink roller group is dividable into upstream and downstream roller subgroups, only ink of a relatively thin ink film thickness distribution in the downstream roller subgroup is supplied to the printing plate, preventing the ink film thickness distribution formed on the printing plate from becoming excessively thick. After the printing plate is replaced and printing of the next job starts, a normal printing product can be obtained in a short time.

DESCRIPTION OF THE PREFERRED EMBODIMENT

Figure 1:
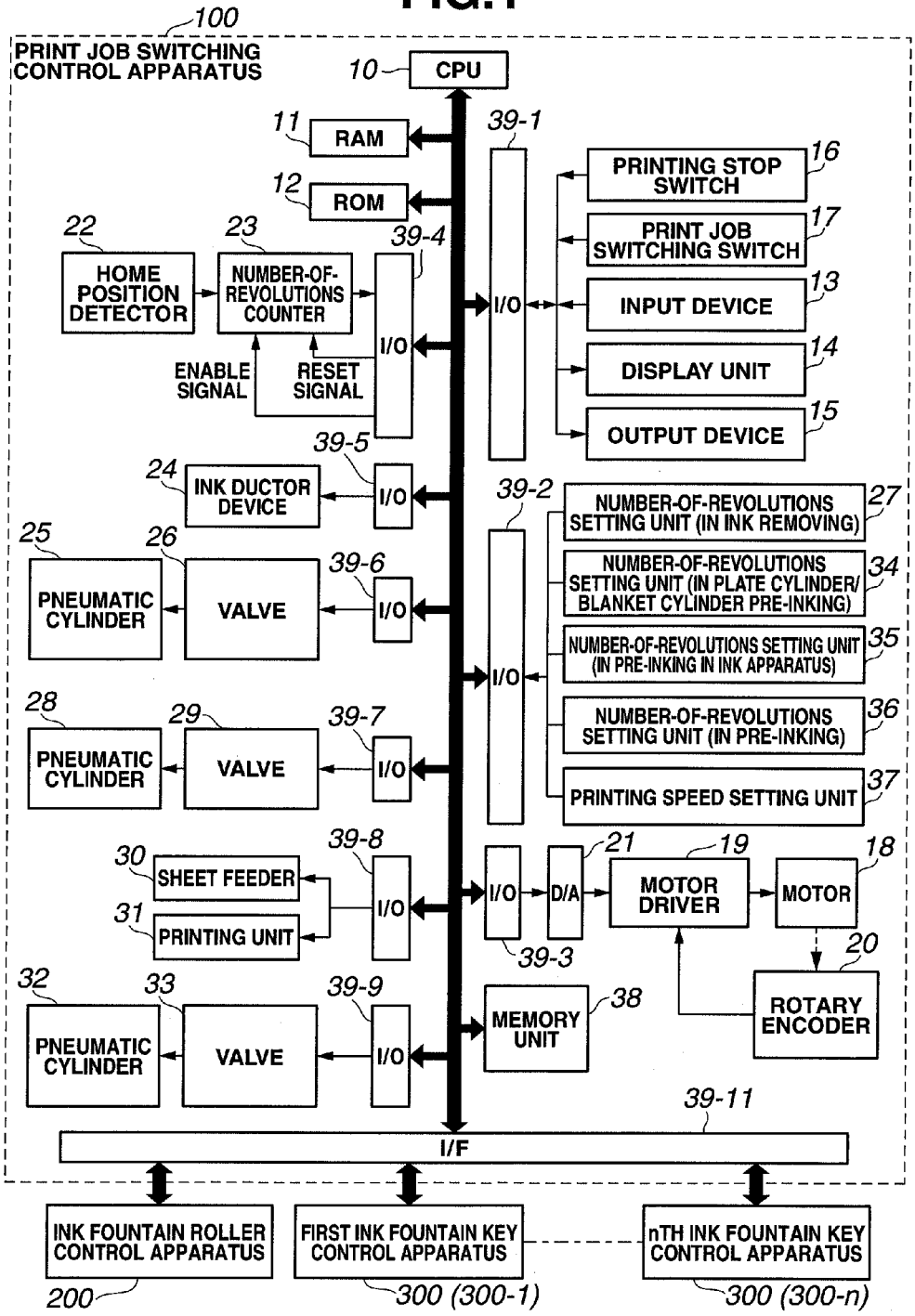
FIG. 1 is a block diagram showing a print job switching control apparatus according to an embodiment of the present invention.

A preferred embodiment of the present invention will be described in detail below with reference to the accompanying drawings.

A print job switching control apparatus 100 includes a CPU 10, a RAM 11, a ROM 12, an input device 13, a display unit 14, an output device (e.g., printer) 15, a printing stop switch 16, a print job switching switch 17, a printing press drive motor 18, a drive motor driver 19, a drive motor rotary encoder 20, a D/A converter 21, a printing press home position detector 22, a counter 23 for counting the number of revolutions of a printing press, and an ink ductor device 24.

The print job switching control apparatus 100 includes a roller group division/coupling pneumatic cylinder 25, a roller group division/coupling pneumatic cylinder valve 26, a dampening form roller throw-on/off pneumatic cylinder 28, a dampening form roller throw-on/off pneumatic cylinder valve 29, a sheet feeder 30, a printing unit 31, an ink form roller throw-on/off pneumatic cylinder 32, an ink form roller throw-on/off pneumatic cylinder valve 33, a number-of-revolutions setting unit 27 in ink removing, a number-of-revolutions setting unit 34 in plate cylinder/blanket cylinder pre-inking, a number-of-revolutions setting unit 35 in pre-inking in the ink apparatus, a number-of-revolutions setting unit 36 in pre-inking, a printing speed setting unit 37, a memory 38, and input/output interfaces (I/O I/Fs) 39-1 to 39-10.

Figure 2:
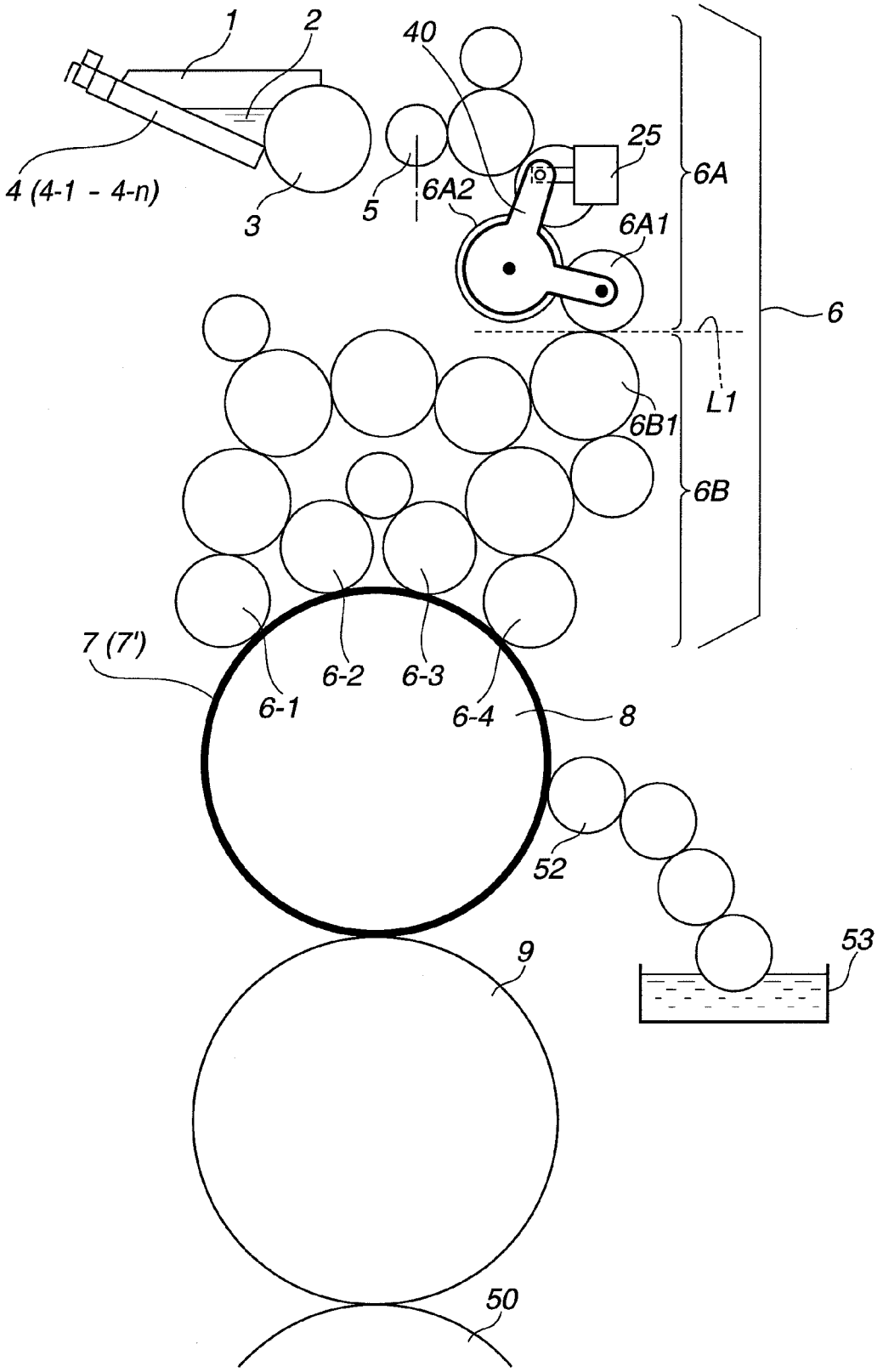
FIG. 2 is a side view showing a state in which an ink roller group is coupled in an ink supply apparatus in a printing unit to be controlled by the print job switching control apparatus shown in FIG. 1.
Figure 14:
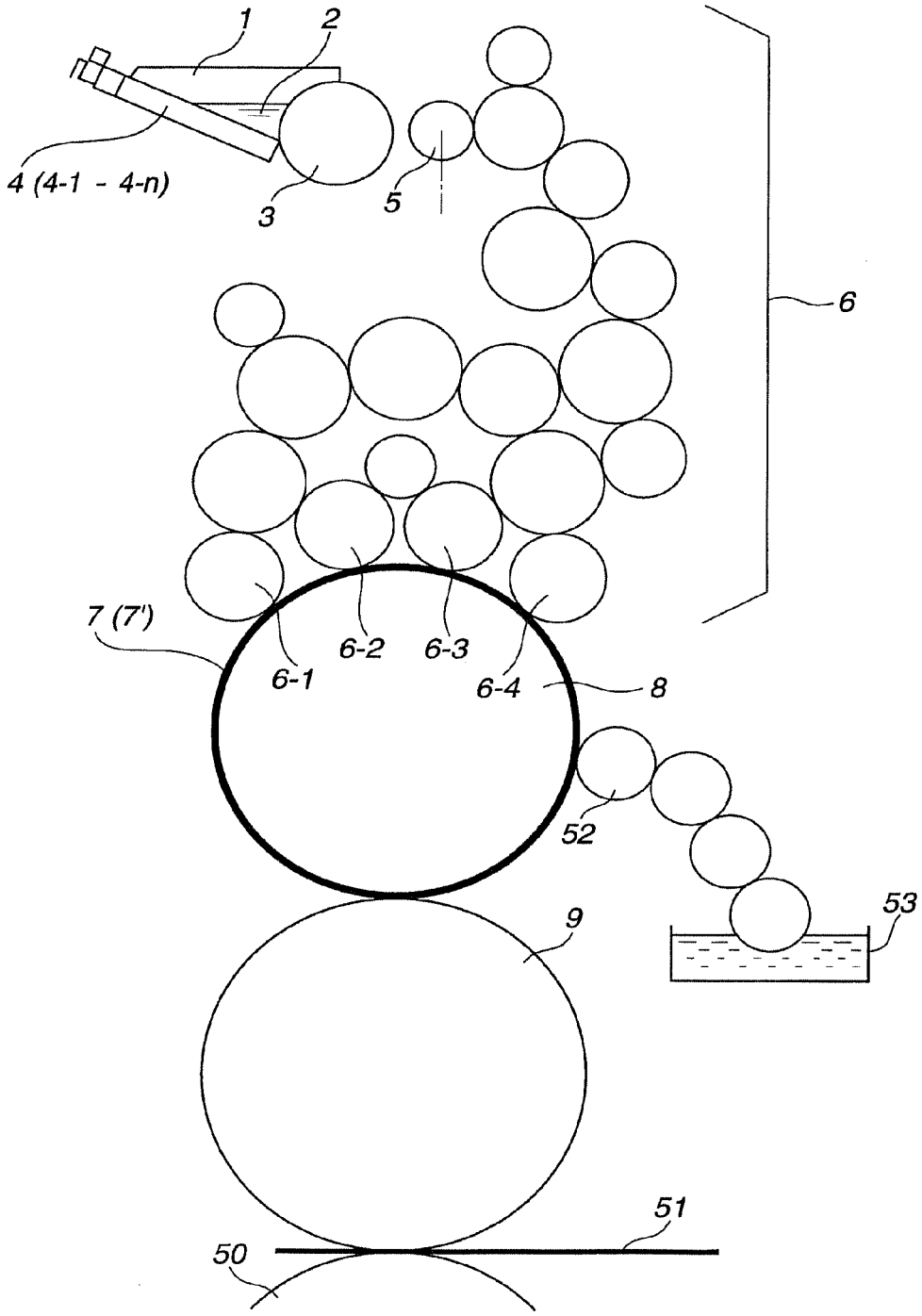
FIG.14 (Prior Art)
FIG. 14 is a view showing the main part of an ink supply apparatus in a printing unit of each color in a printing press.
Figure 15A:
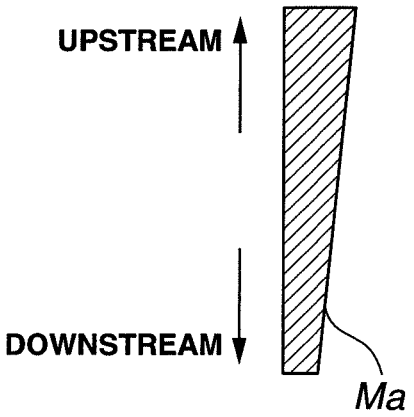
FIGS. 15A and 15B are views showing ink film thickness distributions Ma and Mb formed on the ink roller group of the ink supply apparatus, respectively.
Figure 15B:
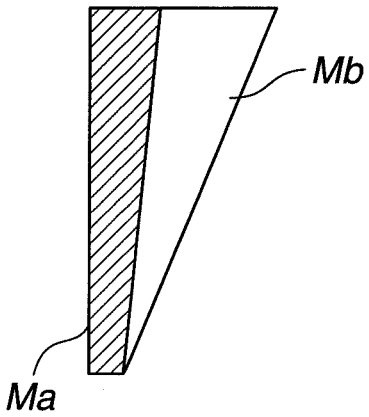

FIG. 2 shows the main part of an ink supply apparatus in each printing unit to be controlled by the print job switching control apparatus 100. In FIG. 2, the same reference numerals as those in FIG. 14 denote the same or similar parts as those shown in FIG. 14, and a description thereof will not be repeated. In the ink supply apparatus, an ink roller group 6 can be divided into an upstream roller subgroup 6A and downstream roller subgroup 6B at the boundary of a dotted line L1 shown in FIG. 2.

More specifically, a roller 6A1 positioned at the lowermost end of the ink flow path of the upstream roller subgroup 6A is axially supported by one end of a swing arm 40 which swings about, as the pivot center, the axis of a roller 6A2 which contacts the outer surface of the roller 6A1. The cylinder 25 is coupled to the other end of the swing arm 40.

In this structure, when the cylinder 25 extends (see FIG. 3), the swing arm 40 swings in a direction indicated by an arrow A about the axis of the roller 6A2 serving as the pivot center. Along with this swing, the roller 6A1 moves apart from a roller 6B1 positioned at the uppermost end of the ink flow path of the downstream roller subgroup 6B while rolling on the roller 6A2. As a result, the ink roller group 6 is divided into the upstream roller subgroup 6A and downstream roller subgroup 6B.

When the cylinder 25 contracts from this state, the swing arm 40 swings in a direction indicated by an arrow B about the axis of the roller 6A2 serving as the pivot center. The roller 6A1 comes into contact with the outer surface of the roller 6B1 at the uppermost end of the downstream roller subgroup 6B while rolling on the roller 6A2 (see FIG. 2). Accordingly, the upstream roller subgroup 6A and downstream roller subgroup 6B are coupled and returned to the single ink roller group 6.

In the print job switching control apparatus 100, the CPU 10 obtains various kinds of information input via the interfaces 39-1 to 39-11. While accessing the RAM 11 and memory unit 38, the CPU 10 operates in accordance with a program stored in the ROM 12.

The encoder 20 generates a rotation pulse at every predetermined rotation angle of the printing press drive motor 18, and outputs it to the drive motor driver 19. The printing press home position detector 22 detects a home position in every rotation of the printing press, generates a home position detection signal, and outputs it to the counter 23.

The ink ductor device 24 is arranged for the ink ductor roller 5. When the ink ductor device 24 is turned on, the ink feed operation of the ink ductor roller 5 starts. When the ink ductor device 24 is turned off, the ink feed operation of the ink ductor roller 5 stops.

The cylinder 28 is arranged for the dampening form roller 52. When the cylinder 28 extends, the dampening form roller 52 is thrown on (comes into contact with a printing plate 7 (7')). When the cylinder 28 contracts, the dampening form roller 52 is thrown off (moves apart from the printing plate 7 (7')).

The cylinder 32 is arranged for ink form rollers 6-1 to 6-4. When the cylinder 32 extends, the ink form rollers 6-1 to 6-4 are thrown on (come into contact with the printing plate 7 (7')). When the cylinder 32 contracts, the ink form rollers 6-1 to 6-4 are thrown off (move apart from the printing plate 7 (7')).

Figure 4:
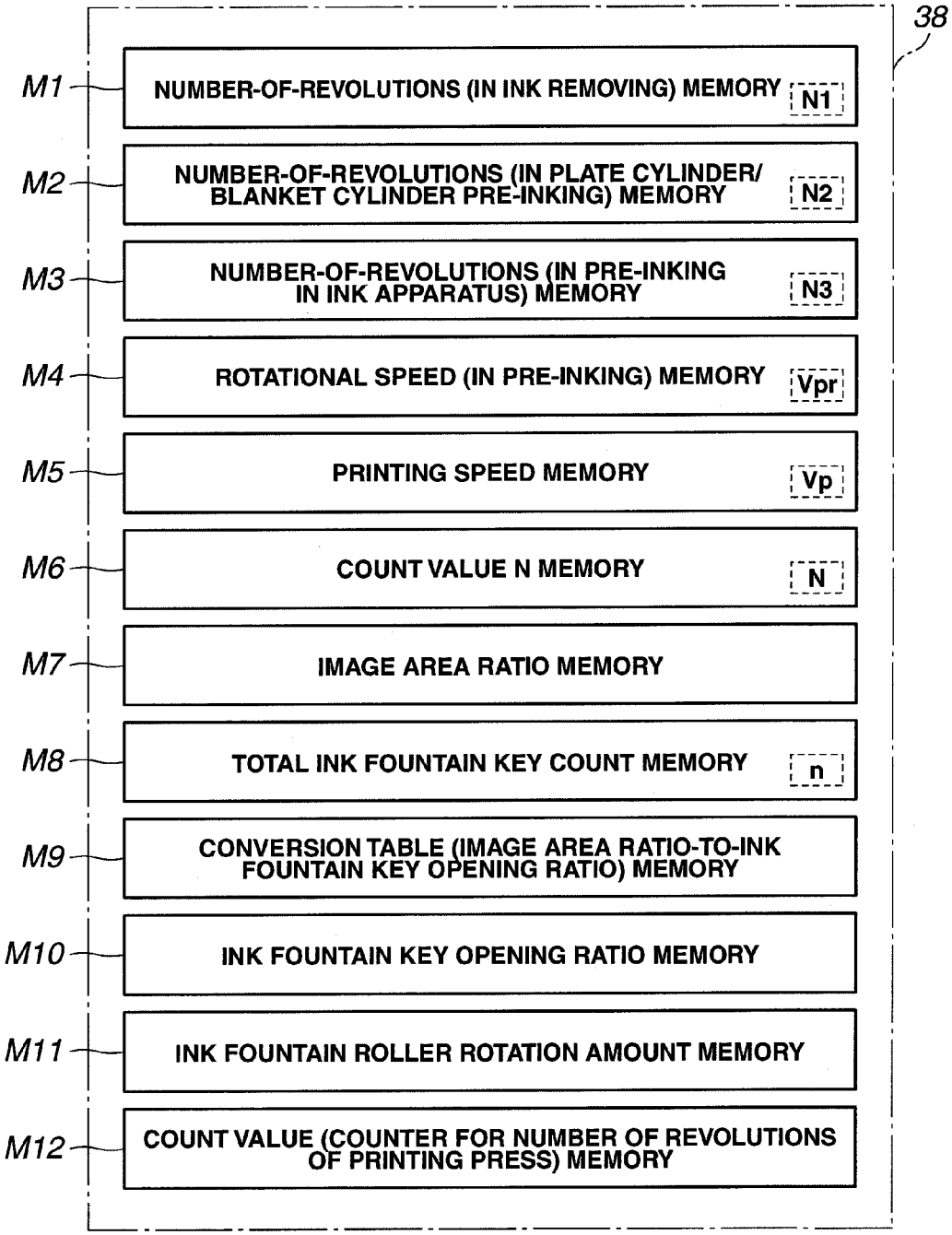
FIG. 4 is a view showing details of the memory unit of the print job switching control apparatus shown in FIG. 1.

FIG. 4 shows the contents of the memory unit 38. The memory unit 38 includes memories M1 to M12. The memory M1 stores the number N1 of revolutions of the printing press in ink removing. The memory M2 stores the number N2 of revolutions of the printing press in plate cylinder/blanket cylinder pre-inking. The memory M3 stores the number N3 of revolutions of the printing press in pre-inking in the ink apparatus. The memory M4 stores a rotational speed Vpr of the printing press in pre-inking. The memory M5 stores a printing speed Vp. The memory M6 stores a count value N. The memory M7 stores the image area ratio of a range corresponding to each ink fountain key. The memory M8 stores a total ink fountain key count n. The memory M9 stores an image area ratio-to-ink fountain key opening ratio conversion table representing the relationship between the image area ratio and the opening ratio of the ink fountain key. The memory M10 stores the opening ratio of each ink fountain key. The memory M11 stores the rotation amount of the ink fountain roller.

The memory M12 stores the count value of the counter for counting the number of revolutions of the printing press.

In FIG. 1, an ink fountain roller control apparatus 200 drives the ink fountain roller 3 in the ink supply apparatus. Ink fountain key control apparatuses 300-1 to **300-*n* control the opening ratios of the ink fountain keys 4-1 to 4-*n* in the ink supply apparatus. The ink fountain roller control apparatus 200 and ink fountain key control apparatuses 300-1 to 300-*n*** are arranged for ink supply apparatuses of respective colors. However, the embodiment will explain one ink supply apparatus for descriptive convenience. That is, the operation of one of the ink supply apparatuses will be explained as a representative.

[Schematic Operation of Print Job Switching Control Apparatus]

Before a description of the detailed operation of the print job switching control apparatus 100, a schematic operation will be explained to facilitate understanding.

Figures 5A, 5B, 5C, 5D, 5E, 5F, 5G, 5H, 5I, 5J:
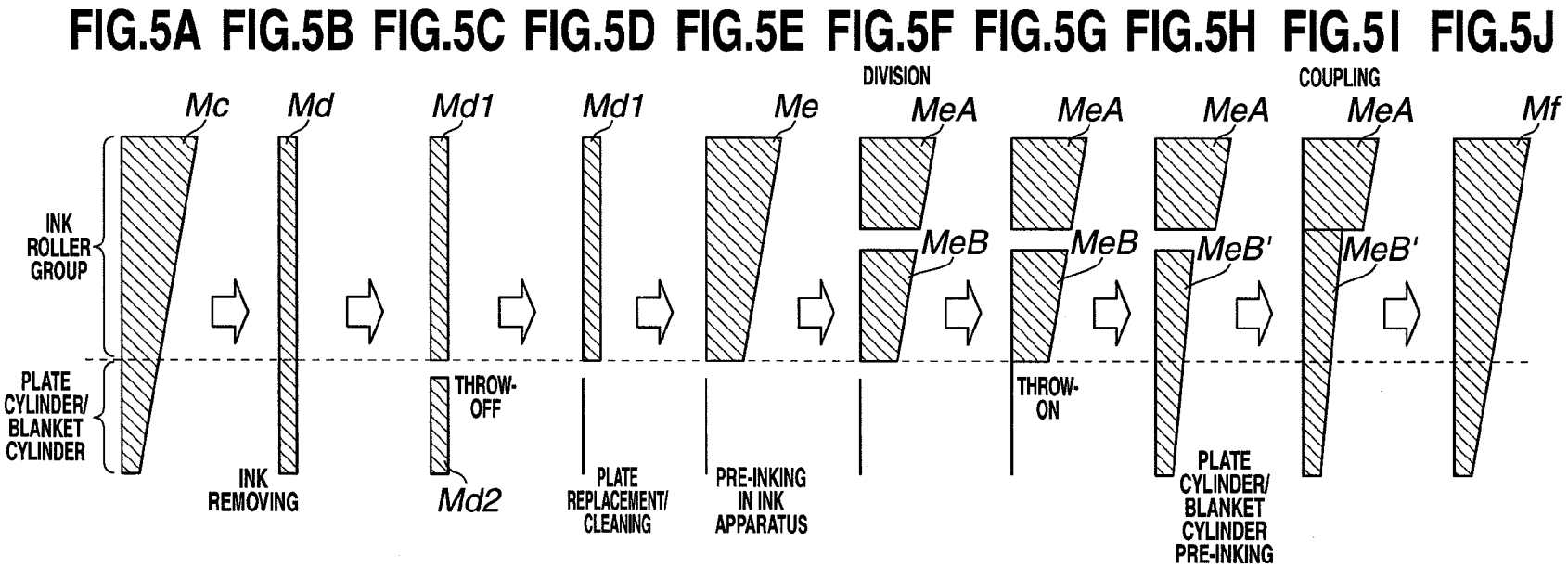
FIGS. 5A to 5J are views showing formation processes for the ink film thickness distribution of the next print job in the ink roller group and on a plate cylinder and blanket cylinder when switching a print job.

(1) Sheet feed is stopped, and printing using the printing plate 7 is stopped (a preceding print job is ended). In this case, an ink film thickness distribution Mc corresponding to an image on the printing plate 7 remains in the ink roller group 6 and on the plate cylinder 8 and blanket cylinder 9, as shown in FIG. 5A. That is, the ink film thickness distribution Mc of the preceding print job remains.

(2) The ink feed operation of the ink ductor roller 5 is stopped. In this state, printing (blank sheet printing) is performed by the number of ink removing sheets to decrease the ink film thickness distribution in the ink supply apparatus to a minimum ink film thickness distribution (reference film thickness) Md required during printing (FIG. 5B: ink removing).

(3) The printing press is stopped, and the ink form rollers 6-1 to 6-4 and the dampening form roller 52 are thrown off (FIG. 5C). The printing plate 7 mounted on the plate cylinder 8 is replaced with the printing plate 7' to be used for printing of the next job, and the blanket cylinder 9 is cleaned (FIG. 5D).

(4) The opening ratios of the ink fountain keys 4-1 to **4-*n* are set to values corresponding to an image on the printing plate 7' to be used for printing of the next job. That is, the opening ratios of the ink fountain keys 4-1 to 4-*n* are set to values corresponding to the image of the next print job. The printing press is speeded up to the rotational speed Vpr in pre-inking. In this state, the ink feed operation of the ink ductor roller 5 is performed by the number N3 of revolutions in pre-inking in the ink apparatus. An ink film thickness distribution Me in printing of the next job is formed in the ink roller group 6 (FIG. 5**E).

(5) The ink feed operation of the ink ductor roller 5 is stopped, and the ink roller group 6 is divided into the upstream roller subgroup 6A and downstream roller subgroup 6B. As shown in FIG. 5F, the ink film thickness distribution Me of the ink roller group 6 is divided into an ink film thickness distribution MeA of the upstream roller subgroup 6A and an ink film thickness distribution MeB of the downstream roller subgroup 6B.

Figure 3:
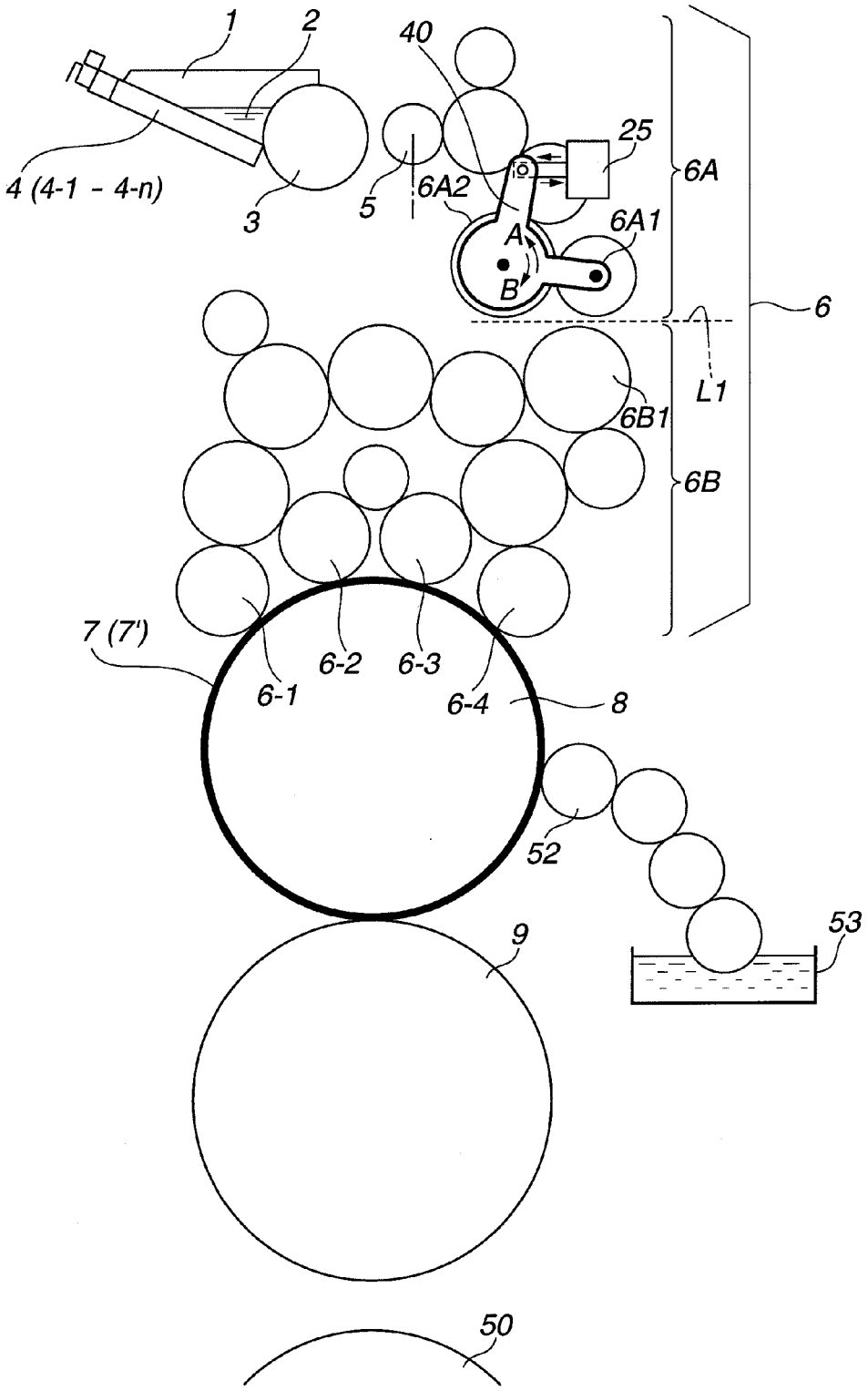
FIG. 3 is a side view showing a state in which the ink roller group is divided in the ink supply apparatus in the printing unit to be controlled by the print job switching control apparatus shown in FIG. 1.

(6) The ink form rollers 6-1 to 6-4 and the dampening form roller 52 are thrown on, and only the plate cylinder 8 and blanket cylinder 9 are thrown on. That is, as shown in FIG. 3, the ink form rollers 6-1 to 6-4 and the dampening form roller 52 contact the plate surface of the printing plate 7', and the blanket cylinder 9 is thrown only on the plate cylinder 8 (the ink feed operation remains stopped). Hence, the downstream roller subgroup 6B, dampening form roller 52, plate cylinder 8, and blanket cylinder 9 are thrown on (FIG. 5G).

(7) In this state, the printing press rotates by the number N2 of revolutions in plate cylinder/blanket cylinder pre-inking, and ink in the downstream roller subgroup 6B is supplied to the printing plate 7' mounted on the plate cylinder 8, and the blanket cylinder 9 (FIG. 5H). In this case, only ink of the relatively thin ink film thickness distribution MeB in the downstream roller subgroup 6B is supplied to the printing plate 7' and blanket cylinder 9, preventing the ink film thickness distribution on the printing plate 7' and blanket cylinder 9 from becoming excessively thick.

Figures 6A, 6B, 6C, 6D, 6E, 6F, 6G, 6H:
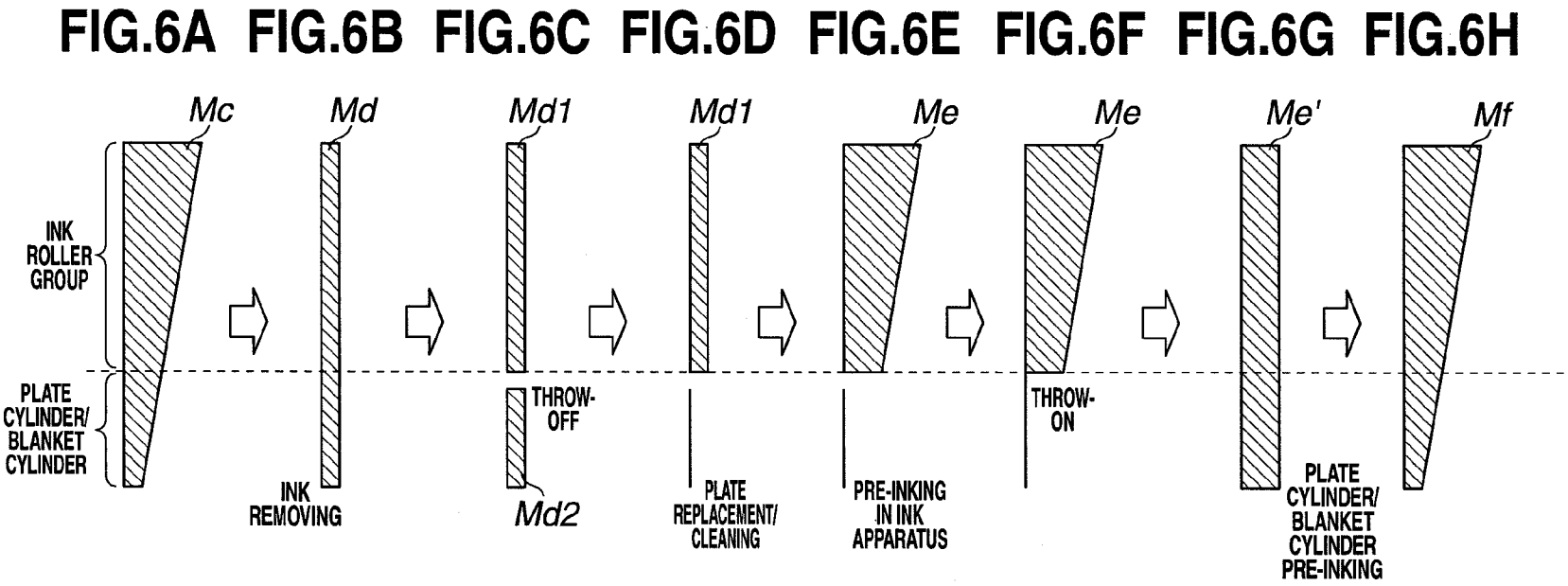
FIGS. 6A to 6H are views showing formation processes for the ink film thickness distribution when the ink film thickness distribution of the next print job is formed without dividing the ink roller group.

As shown in FIGS. 6A to 6J, it is possible to, after the process in FIG. 6E corresponding to FIG. 5E, throw on the ink form rollers 6-1 to 6-4, dampening form roller 52, plate cylinder 8, and blanket cylinder 9 without dividing the ink roller group 6 (FIG. 6F), rotate the printing press by a predetermined number of times, and supply ink to even the plate cylinder 8 and blanket cylinder 9. In this case, however, all ink in the ink supply apparatus is leveled by the ink roller group 6, plate cylinder 8, and blanket cylinder 9. Thus, an excessively large amount of ink is supplied to the plate cylinder 8 and blanket cylinder 9, and the ink film thickness distribution on the plate cylinder 8 and blanket cylinder 9 becomes excessively thick (FIG. 6G).

To the contrary, after the process in FIG. 5E, the ink roller group 6 is divided into the upstream roller subgroup 6A and downstream roller subgroup 6B (FIG. 5F). In this case, only ink of the relatively thin ink film thickness distribution MeB in the downstream roller subgroup 6B is supplied to the printing plate 7' and blanket cylinder 9 (FIGS. 5G and 5H), preventing the ink film thickness distribution on the printing plate 7' and blanket cylinder 9 from becoming excessively thick.

(8) Thereafter, the upstream roller subgroup 6A and downstream roller subgroup 6B are coupled and returned to the single ink roller group 6 (FIG. 5I). The ink feed operation of the ink ductor roller 5 is performed. The blanket cylinder 9 is thrown even on the impression cylinder 50, that is, an impression throw-on state in which the plate cylinder 8, blanket cylinder 9, and impression cylinder 50 contact each other is set (see FIG. 2). Then, printing of the next job starts using the printing plate 7' mounted on the plate cylinder 8.

In this case, an ink film thickness distribution (ink film thickness distribution in final printing) in printing of the next job is formed during printing. At this time, an ink film thickness distribution MeB' in the downstream roller subgroup 6B and on the plate cylinder 8 and blanket cylinder 9 has become thin. Thus, ink flows fast from the upstream side to the downstream side, quickly forming an ink film thickness distribution Mf (FIG. 5J) during final printing in the ink roller group 6 and on the plate cylinder 8 and blanket cylinder 9.

According to the method shown in FIGS. 6A to 6H, the ink film thickness distribution on the plate cylinder 8 and blanket cylinder 9 becomes excessively thick (FIG. 6G). Time is therefore taken to form an ink film thickness distribution Mf (FIG. 6H) during final printing, wasting many sheets. In contrast, the embodiment prevents the ink film thickness distribution formed on the plate cylinder 8 and blanket cylinder 9 from becoming excessively thick. Ink flows fast from the upstream side to the downstream side, quickly forming an ink film thickness distribution during final printing in the ink roller group 6 and on the plate cylinder 8 and blanket cylinder 9. After the printing plate 7' is replaced and printing of the next job starts, a normal printing product can be obtained in a short time.

Figures 7A, 7B, 7C, 7D, 7E, 7F, 7G, 7H, 7I, 7J:
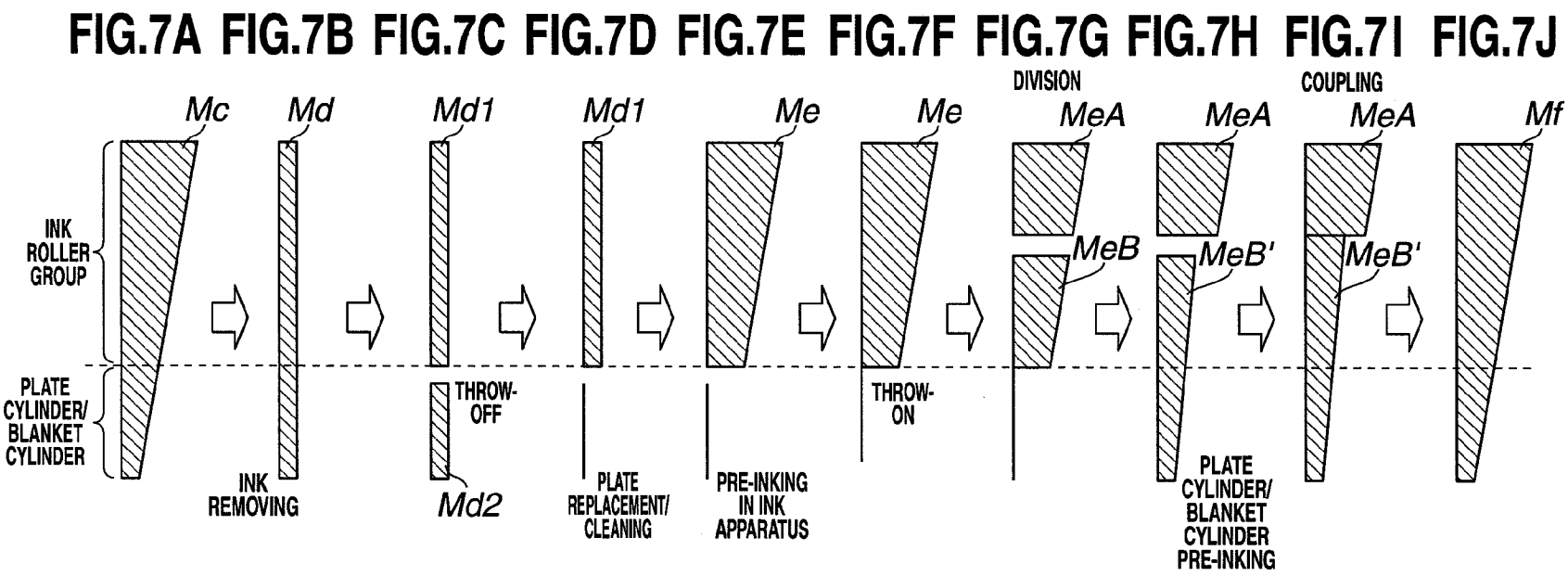
FIGS. 7A to 7J are views showing formation processes for the ink film thickness distribution when a downstream roller subgroup, the plate cylinder, and the blanket cylinder are thrown on before dividing the ink roller group.

In the schematic operation described with reference to FIGS. 5A to 5J, the ink roller group 6 is divided into the upstream roller subgroup 6A and downstream roller subgroup 6B (FIG. 5F), and then the downstream roller subgroup 6B is thrown on the plate cylinder 8 (FIG. 5G). However, as shown in FIGS. 7A to 7J, it is also possible to throw the downstream roller subgroup 6B on the plate cylinder 8 before dividing the ink roller group 6 into the upstream roller subgroup 6A and downstream roller subgroup 6B (FIG. 7F), and then divide the roller group 6 into the upstream roller subgroup 6A and downstream roller subgroup 6B (FIG. 7G).

[Detailed Operation of Print Job Switching Control Apparatus]

Figure 8A:
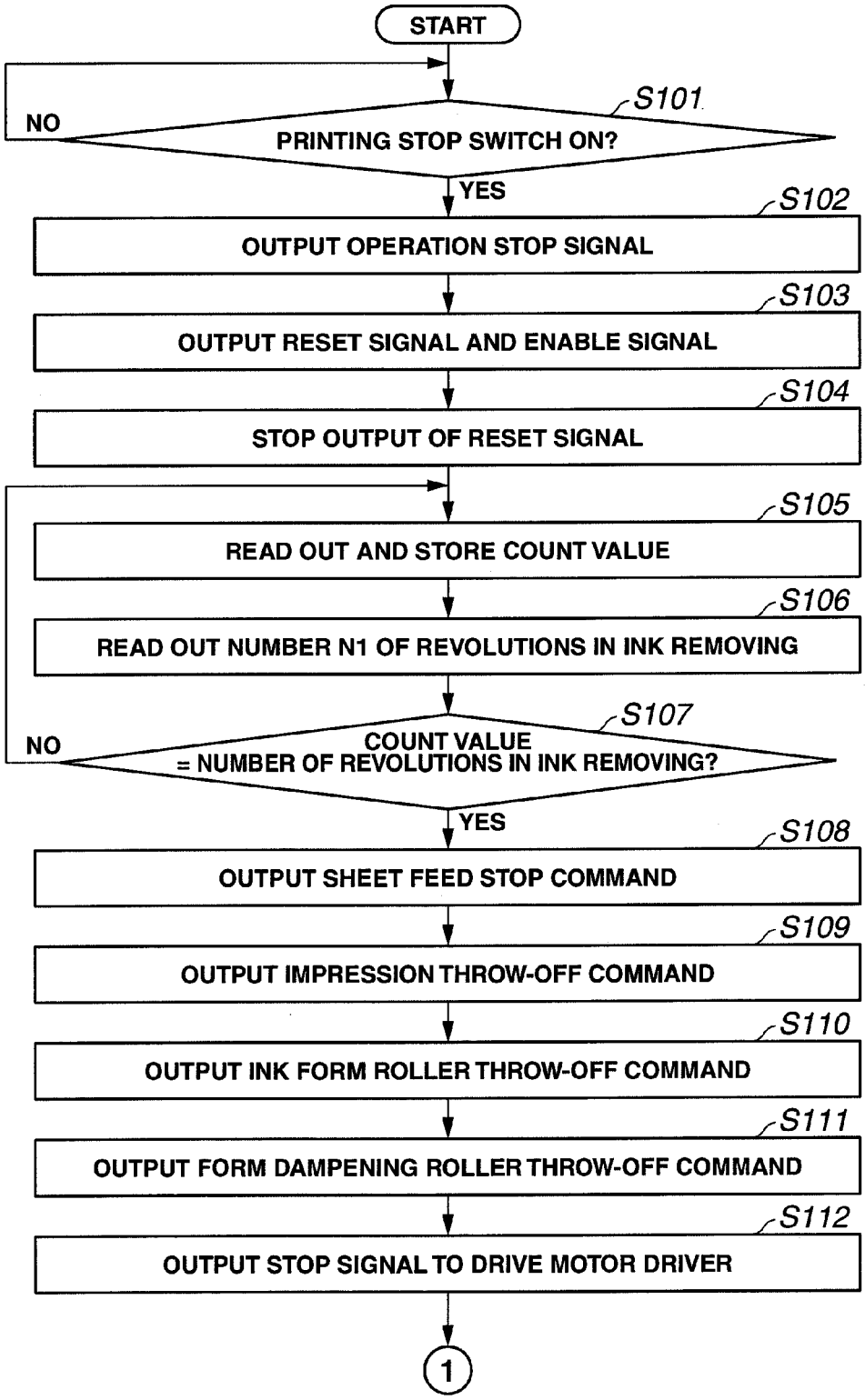
FIGS. 8A to 8H are flowcharts for explaining the processing operation of a CPU shown in FIG. 1.

When switching a print job, the operator turns on the printing stop switch 16. Then, the CPU 10 confirms that the printing stop switch 16 has been turned on (FIG. 8A: YES in step S101), and outputs an operation stop signal to the ink ductor device 24 (step S102) to stop the ink feed operation of the ink ductor roller 5. In this case, the ink film thickness distribution Mc corresponding to an image on the printing plate 7 remains in the ink roller group 6 and on the plate cylinder 8 and blanket cylinder 9, as shown in FIG. 5A. That is, the ink film thickness distribution Mc of a preceding print job remains.

[Ink Removing]

While stopping the ink feed operation of the ink ductor roller 5, the CPU 10 outputs a reset signal and enable signal to the counter 23 (step S103). The CPU 10 then stops the output of the reset signal to the counter 23 (step S104), and reads out the count value of the counter 23 (step S105). The CPU 10 reads out the number N1 of revolutions in ink removing that is stored in the memory M1 (step S106). The CPU 10 compares the readout count value of the counter 23 with the number N1 of revolutions in ink removing (step S107). Assume that, before switching the print job, the memory M1 receives and stores in advance the number N1 of revolutions in ink removing via the number-of-revolutions setting unit 27 in ink removing.

While repeating the processing operations in steps S105 to S107, the CPU 10 continues printing on a fed sheet. If the count value of the counter 23 reaches the number N1 of revolutions in ink removing (YES in step S107), the CPU 10 outputs a sheet feed stop command to the sheet feeder 30 (YES in step S107), and stops sheet feed to the printing press (step S108). Hence, printing (blank sheet printing) is performed by the number of ink removing sheets to decrease the ink film thickness distribution in the ink supply apparatus to the minimum ink film thickness distribution (reference film thickness) Md required during printing (FIG. 5B).

Then, the CPU 10 outputs an impression throw-off command, ink form roller throw-off command, and dampening form roller throw-off command (steps S109, S110, and S111). By the impression throw-off command, the blanket cylinder 9 is thrown off the plate cylinder 8 and impression cylinder 50. By the ink form roller throw-off command, the ink form rollers 6-1 to 6-4 are thrown off and separated from the printing plate 7. By the dampening form roller throw-off command, the dampening form roller 52 is thrown off and separated from the printing plate 7 (FIG. 5C). The CPU 10 outputs a stop signal to the drive motor driver 19 to stop the encoder 20. As a result, the printing press stops.

[Data Input]

Figure 8B:
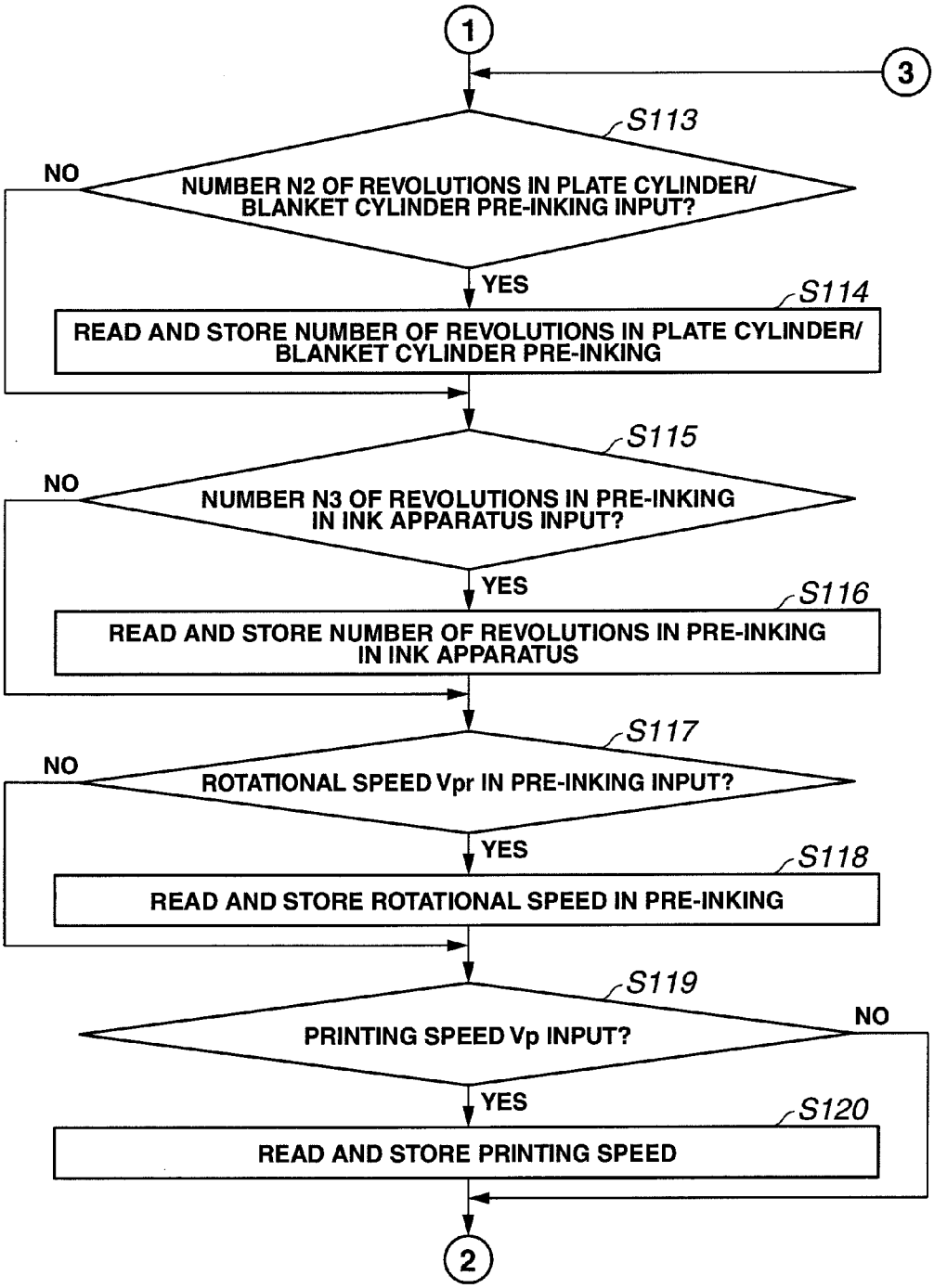

The operator inputs the number N2 of revolutions of the printing press in plate cylinder/blanket cylinder pre-inking, the number N3 of revolutions of the printing press in pre-inking in the ink apparatus, the rotational speed Vpr of the printing press in pre-inking, and the printing speed Vp (FIG. 8B: steps S113, S115, S117, and S119).

In this case, the number N2 of revolutions of the printing press in plate cylinder/blanket cylinder pre-inking is input from the number-of-revolutions setting unit 34 in plate cylinder/blanket cylinder pre-inking. The number N3 of revolutions of the printing press in pre-inking in the ink apparatus is input from the number-of-revolutions setting unit 35 in pre-inking in the ink apparatus. The rotational speed Vpr of the printing press in pre-inking is input from the number-of-revolutions setting unit 36 in pre-inking. The printing speed Vp is input from the printing speed setting unit 37.

The CPU 10 stores, in the memory M2, the number N2 of revolutions in plate cylinder/blanket cylinder pre-inking that has been input from the number-of-revolutions setting unit 34 in plate cylinder/blanket cylinder pre-inking (step S114). The CPU 10 stores, in the memory M3, the number N3 of revolutions of the printing press in pre-inking in the ink apparatus that has been input from the number-of-revolutions setting unit 35 in pre-inking in the ink apparatus (step S116). The CPU 10 stores, in the memory M4, the rotational speed Vpr of the printing press in pre-inking that has been input from the number-of-revolutions setting unit 36 in pre-inking (step S118). The CPU 10 stores, in the memory M5, the printing speed Vp that has been input from the printing speed setting unit 37 (step S120).

[Input of Image Area Ratio of Printing Plate for Next Print Job]

The CPU 10 stores, in the memory M7, the image area ratios of ranges corresponding to the ink fountain keys 4-1 to **4-*n* on the printing plate 7 that have been input from the input device 13. In the embodiment, the image area ratios of the ranges corresponding to the ink fountain keys 4-1 to 4-*n* on the printing plate 7 are measured using an "image area ratio measurement apparatus" as disclosed in Japanese Patent Laid-Open No. 58-201008 (patent literature 4) or Japanese Patent Laid-Open No. 58-201010 (patent literature 5). Image area ratios measured using the "image area ratio measurement apparatus" are written in a portable memory. The portable memory in which the image area ratios are written is set in the input device 13, inputting the image area ratios of the ranges corresponding to the ink fountain keys 4-1 to 4-*n* on the printing plate 7. Note that the CPU 10 and the "image area ratio measurement apparatus" may be connected online to directly receive, from the "image area ratio measurement apparatus", the image area ratios of the ranges corresponding to the ink fountain keys 4-1 to 4-*n* on the printing plate 7**.

Figure 8C:
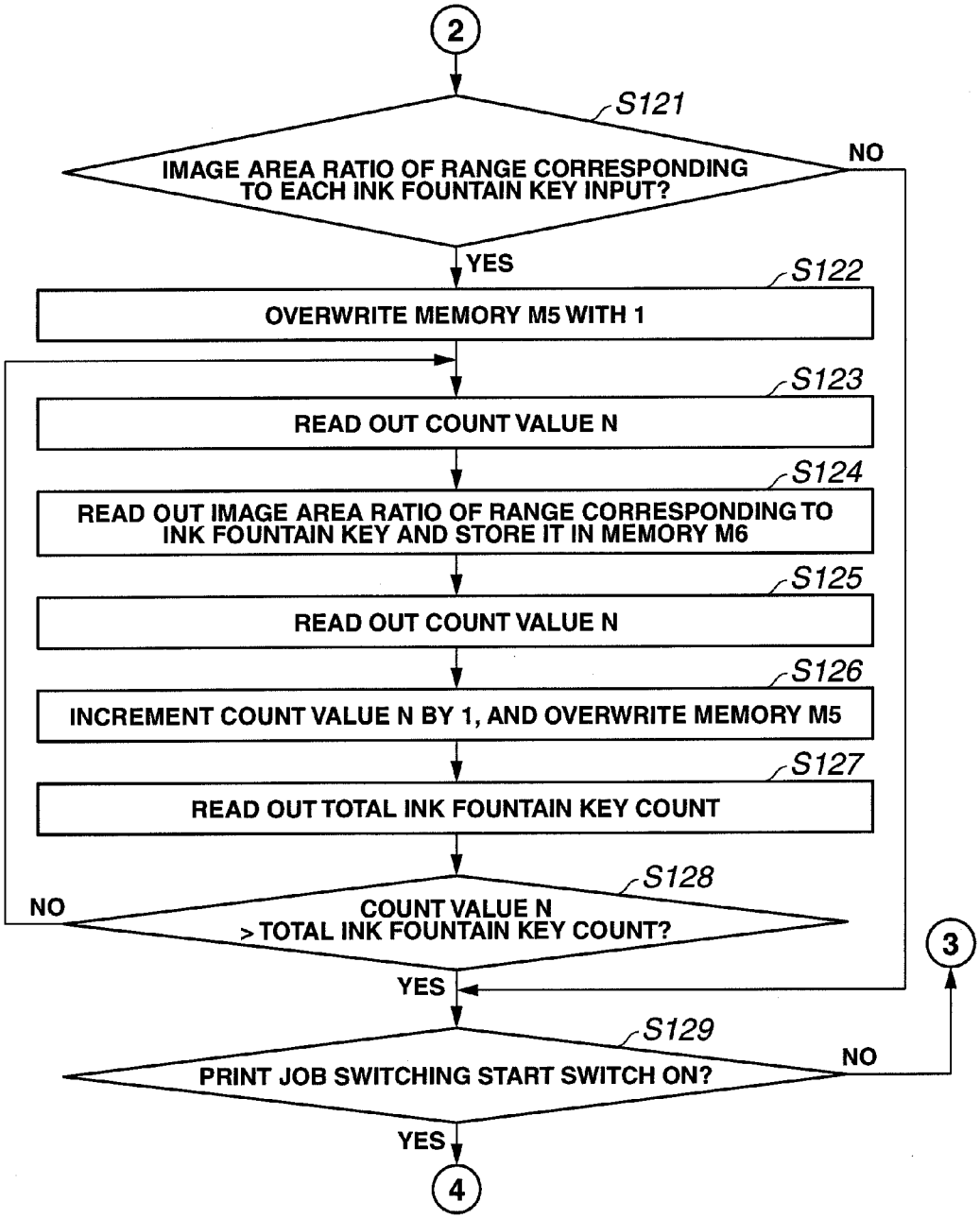

If the portable memory is set in the input device 13, that is, the image area ratios of the ranges corresponding to the ink fountain keys 4-1 to **4-*n* are input (FIG. 8C: YES in step S121), the CPU 10 overwrites the count value N in the memory M6 with N=1 (step S122), and reads out the count value N from the memory M6 (step S123). The CPU 10 reads out the image area ratio of a range corresponding to the Nth ink fountain key from the portable memory, and stores it at an address position for the Nth ink fountain key in the memory M7 (step S124**).

The CPU 10 reads out the count value N from the memory M6 (step S125), increments the count value N by one, and overwrites the memory M6 with it (step S126). The CPU 10 reads out the total ink fountain key count n from the memory M8 (step S127). The CPU 10 repeats the processing operations in steps S123 to S128 until the count value N exceeds the total ink fountain key count n (YES in step S128). As a result, the image area ratios of the respective regions corresponding to the ink fountain keys 4-1 to **4-*n* on the printing plate 7 are read out from the portable memory, and stored in the memory M7**.

[Plate Replacement & Cleaning]

While the printing press stops and the ink form rollers 6-1 to 6-4 and the dampening form roller 52 are thrown off (FIG. 5C), the operator replaces the printing plate 7 mounted on the plate cylinder 8 with the printing plate 7' to be used for printing of the next job, and cleans the blanket cylinder 9 (FIG. 5D).

[Setting of Opening Ratio of Ink Fountain Key Corresponding to Image on Printing Plate for Next Print Job]

Figure 8D:
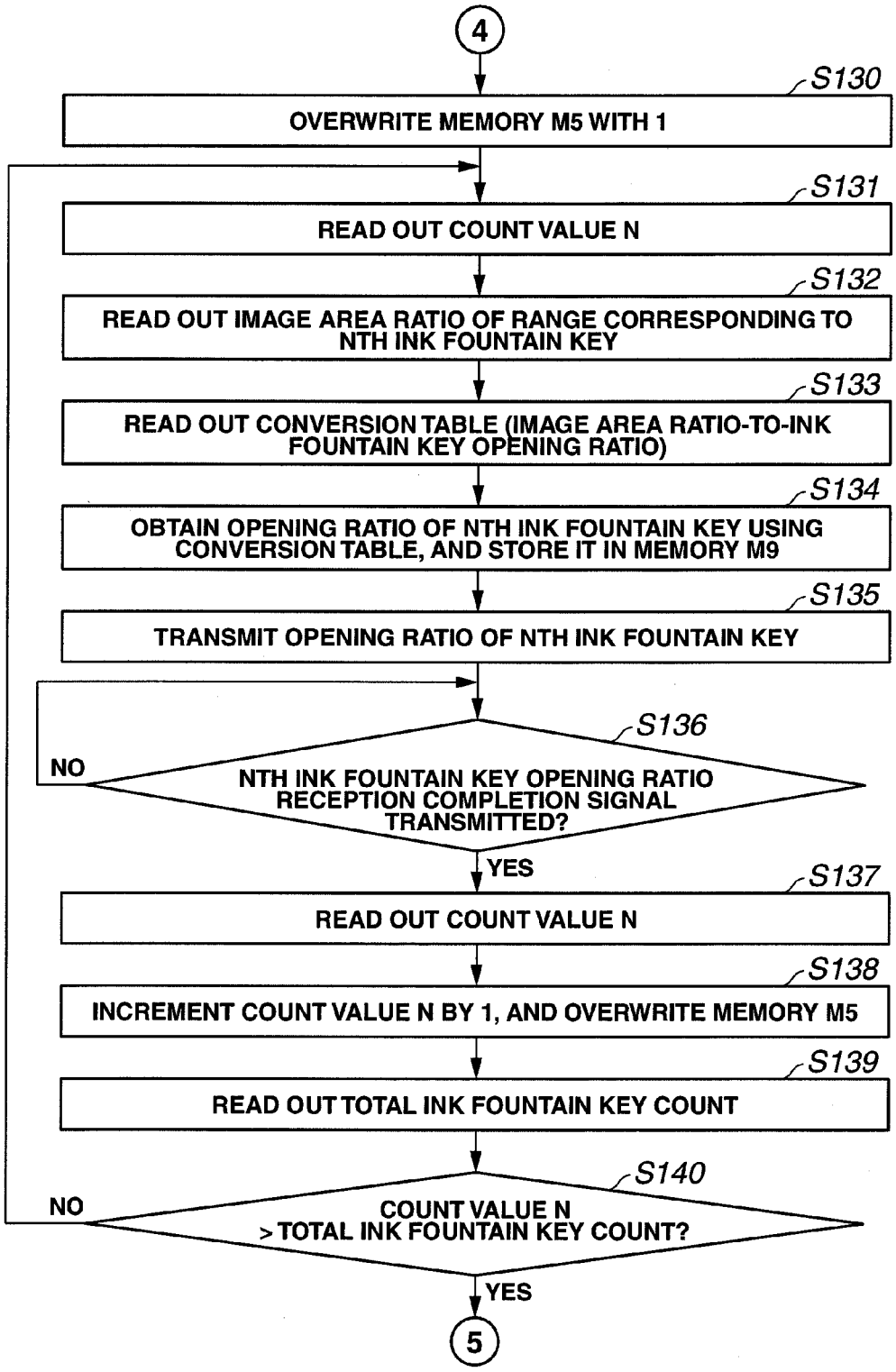

The operator turns on the print job switching switch 17. If the print job switching switch 17 has been turned on (YES in step S129), the CPU 10 overwrites the count value N in the memory M6 with N=1 (FIG. 8D: step S130). The CPU 10 reads out the count value N from the memory M6 (step S131), and reads out the image area ratio of the range corresponding to the Nth ink fountain key from the address position for the Nth ink fountain key in the memory M7 (step S132).

The CPU 10 reads out the image area ratio-to-ink fountain key opening ratio conversion table from the memory M9 (step S133). By using the image area ratio-to-ink fountain key opening ratio conversion table, the CPU 10 obtains the opening ratio of the Nth ink fountain key from the image area ratio of the range corresponding to the Nth ink fountain key. The CPU 10 stores the obtained opening ratio of the Nth ink fountain key at an address position for the Nth ink fountain key in the memory M10 (step S134), and transmits it to the Nth ink fountain key control apparatus 300 (step S135).

The CPU 10 confirms that the Nth ink fountain key control apparatus 300 has transmitted an Nth ink fountain key opening ratio reception completion signal (YES in step S136). Then, the CPU 10 reads out the count value N from the memory M6 (step S137), increments the count value N by one, and overwrites the memory M6 with it (step S138). The CPU 10 reads out the total ink fountain key count n from the memory M8 (step S139). The CPU 10 repeats the processing operations in steps S131 to S140 until the count value N exceeds the total ink fountain key count n (YES in step S140).

Accordingly, the opening ratios of the ink fountain keys 4-1 to **4-*n* that correspond to the image area ratios of the ranges corresponding to the ink fountain keys 4-1 to 4-*n* on the printing plate 7' are obtained, stored in the memory M10, and transmitted to the ink fountain key control apparatuses 300-1 to 300-*n***.

[Confirmation of Completion of Setting Opening Ratio of Ink Fountain Key]

Figure 8E:
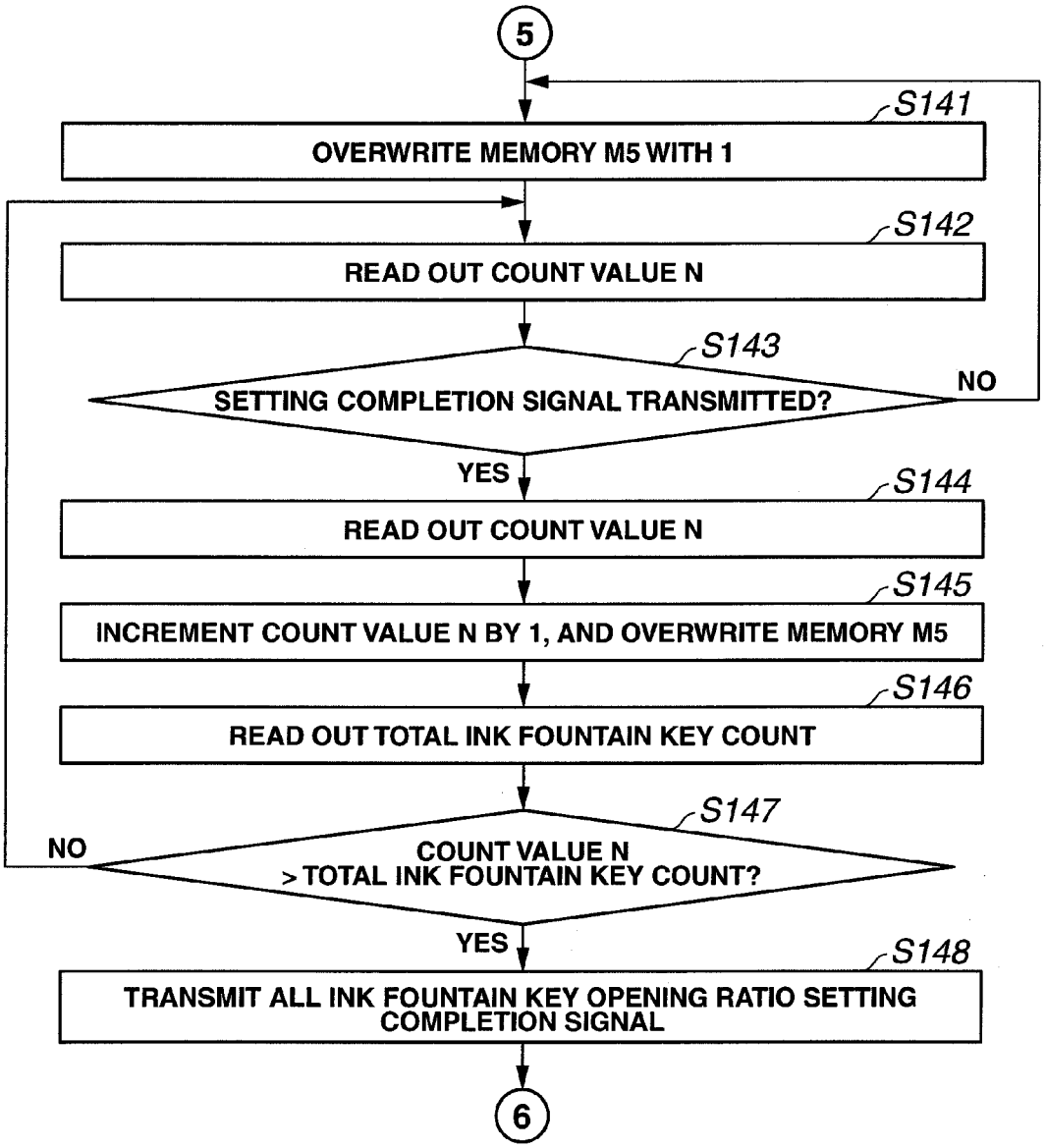

The CPU 10 overwrites the count value N in the memory M6 with N=1 (FIG. 8E: step S141), and reads out the count value N from the memory M6 (step S142). The CPU 10 confirms the presence/absence of an ink fountain key opening ratio setting completion signal from the Nth ink fountain key control apparatus 300 (step S143).

If the CPU 10 confirms that the Nth ink fountain key control apparatus 300 has transmitted the ink fountain key opening ratio setting completion signal (YES in step S143), the CPU 10 reads out the count value N from the memory M6 (step S144). The CPU 10 increments the count value N by one, and overwrites the memory M6 with it (step S145). The CPU 10 reads out the total ink fountain key count n from the memory M8 (step S146). The CPU 10 repeats the processing operations in steps S142 to S147 until the count value N exceeds the total ink fountain key count n (YES in step S147).

If the count value N exceeds the total ink fountain key count n (YES in step S147), the CPU 10 determines that the setting of the opening ratios of the ink fountain keys has been completed. The CPU 10 transmits an all ink fountain key opening ratio setting completion signal to all the ink fountain key control apparatuses 300 (300-1 to **300-*n*) (step S148**).

[Pre-Inking in Ink Apparatus (Ink Film Thickness Distribution Forming Step)]

Figure 8F:
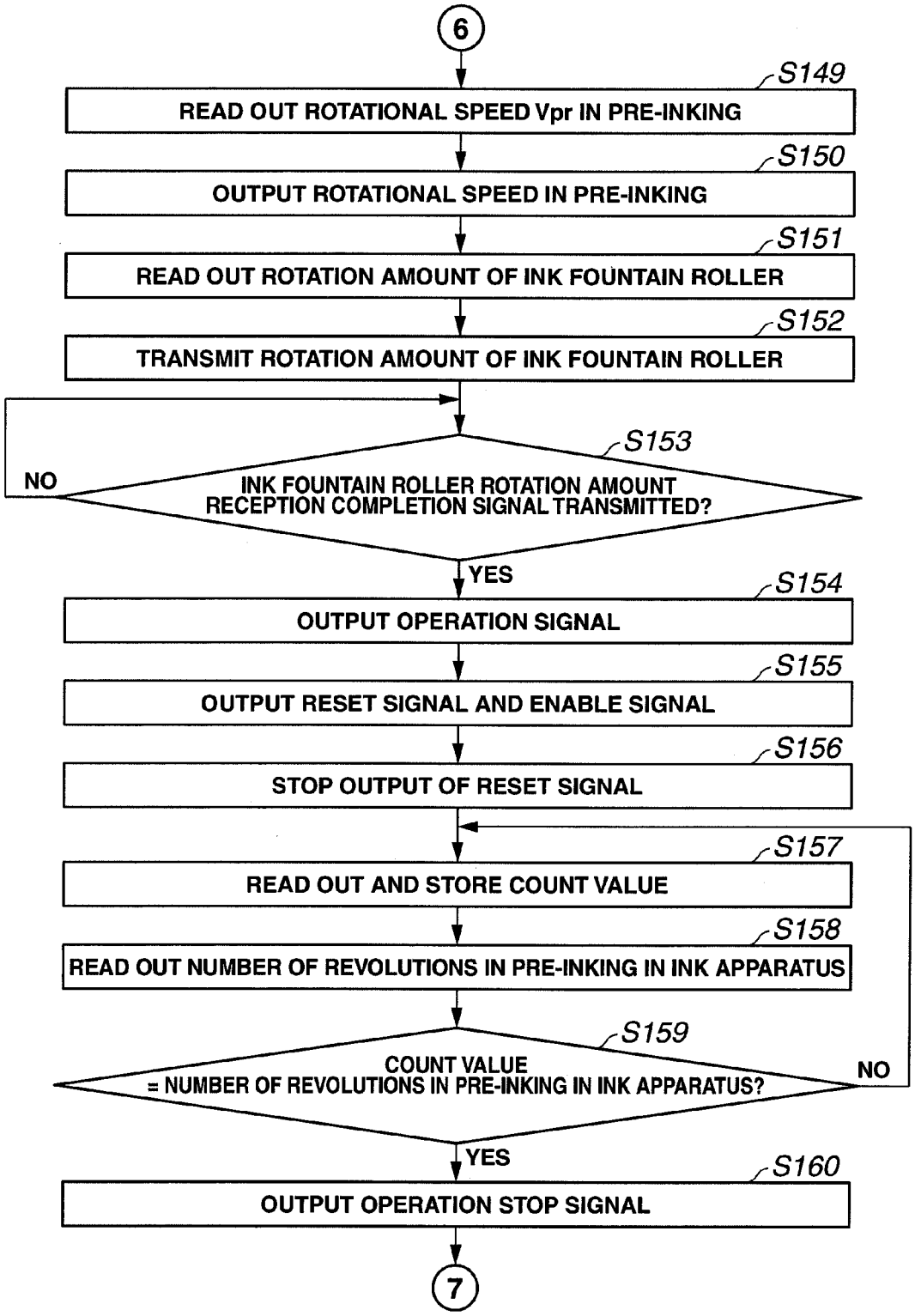

After transmitting the all ink fountain key opening ratio setting completion signal to all the ink fountain key control apparatuses 300 (step S148), the CPU 10 reads out the rotational speed Vpr in pre-inking that is stored in the memory M4 (FIG. 8F: step S149), and outputs the readout rotational speed Vpr in pre-inking to the drive motor driver 19 (step S150). The CPU 10 reads out the rotation amount of the ink fountain roller that is stored in the memory M11 (step S151), and transmits the readout rotation amount of the ink fountain roller to the ink fountain roller control apparatus 200 (step S152).

If the CPU 10 receives an ink fountain roller rotation amount reception completion signal from the ink fountain roller control apparatus 200 (YES in step S153), it outputs an operation signal to the ink ductor device 24 (step S154), and starts the ink feed operation of the ink ductor roller 5. The CPU 10 continues the ink feed operation of the ink ductor roller 5 until the number of revolutions of the printing press reaches the number N3 of revolutions in pre-inking in the ink apparatus that is stored in the memory M3 (steps S155 to S160).

More specifically, the CPU 10 outputs a reset signal and enable signal to the counter 23 (step S155). The CPU 10 stops the output of the reset signal to the counter 23 (step S156), and starts, from 0, the count operation of the counter 23. The CPU 10 reads out the count value of the counter 23, and stores it in the memory M12 (step S157). The CPU 10 reads out, from the memory M3, the number N3 of revolutions in pre-inking in the ink apparatus (step S158). The CPU 10 repeats the processing operations in steps S157 to S159 until the count value of the counter 23 reaches the number N3 of revolutions in pre-inking in the ink apparatus (YES in step S159).

As a result, the ink film thickness distribution Me in printing of the next job is formed in the ink roller group 6 (FIG. 5C).

[Division of Ink Roller Group (Roller Group Division Step)]

If the count value of the counter 23 reaches the number N3 of revolutions in pre-inking in the ink apparatus (YES in step S159), the CPU 10 outputs an operation stop signal to the ink ductor device 24 to stop the ink feed operation of the ink ductor roller 5 (step S160).

Figure 8G:
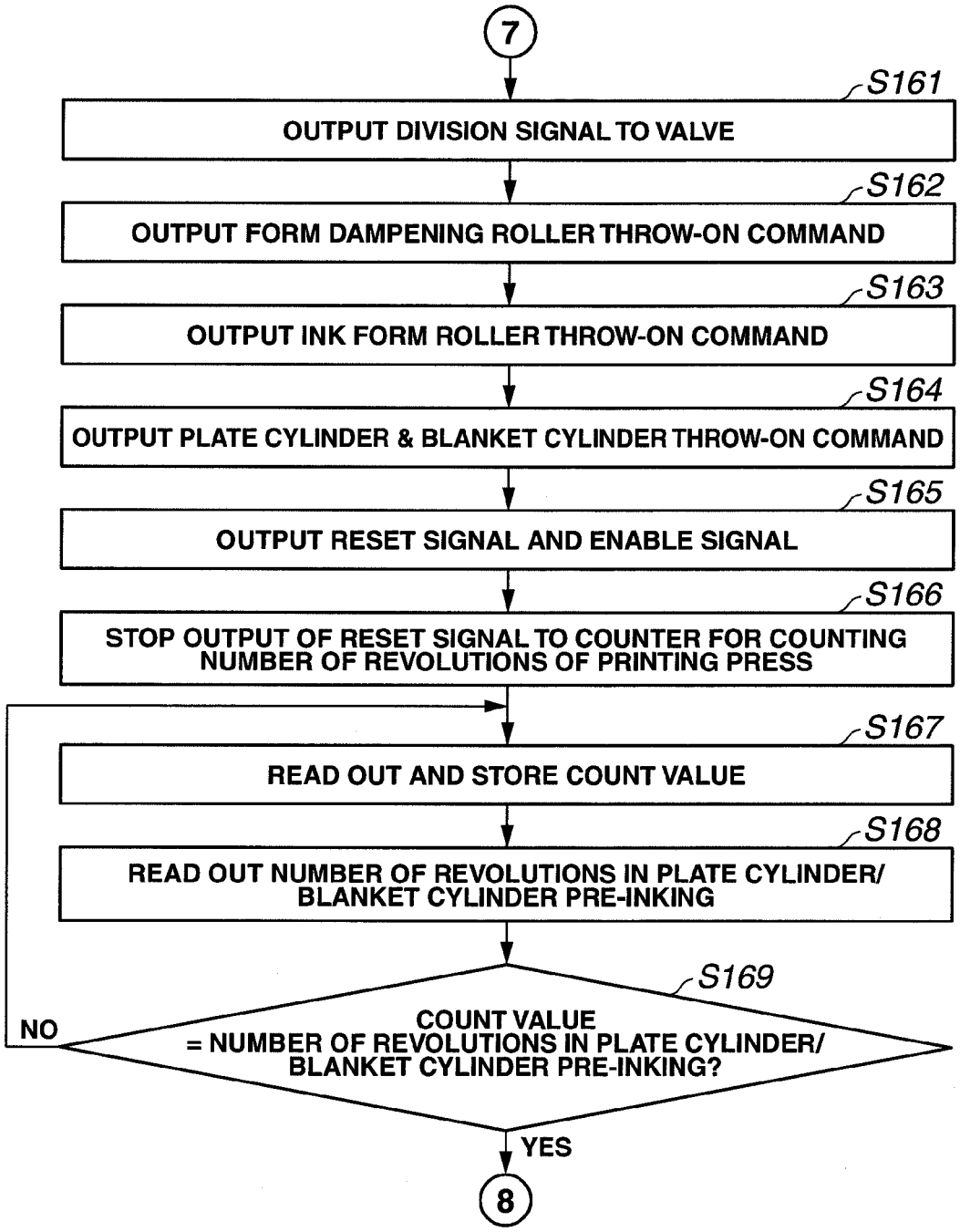

After that, the CPU 10 outputs a division signal to the valve 26 (FIG. 8G: step S161) to divide the ink roller group 6 into the upstream roller subgroup 6A and downstream roller subgroup 6B (see FIG. 3).

As shown in FIG. 5F, the ink film thickness distribution Me of the ink roller group 6 is divided into the ink film thickness distribution MeA of the upstream roller subgroup 6A and the ink film thickness distribution MeB of the downstream roller subgroup 6B.

[Throw-on of Downstream Roller Subgroup, Plate Cylinder, And Blanket Cylinder (Throw-on Step)]

The CPU 10 outputs a dampening form roller throw-on command, ink form roller throw-on command, and plate cylinder & blanket cylinder throw-on command (steps S162, S163, and S164). By the dampening form roller throw-on command, the dampening form roller 52 is thrown on and contacts the printing plate 7'. By the ink form roller throw-on command, the ink form rollers 6-1 to 6-4 are thrown on and contact the printing plate 7'. By the plate cylinder & blanket cylinder throw-on command, only the plate cylinder 8 and blanket cylinder 9 are thrown on. That is, the blanket cylinder 9 is thrown only on the plate cylinder 8. Accordingly, the downstream roller subgroup 6B, plate cylinder 8, and blanket cylinder 9 are thrown on (FIG. 5G).

[Plate Cylinder/Blanket Cylinder Pre-Inking (Ink Supply Step)]

In this state, the CPU 10 rotates the printing press until the number of revolutions of the printing press reaches the number N2 of revolutions in plate cylinder/blanket cylinder pre-inking that is stored in the memory M2 (steps S165 to S169).

More specifically, the CPU 10 outputs a reset signal and enable signal to the counter 23 (step S165). The CPU 10 then stops the output of the reset signal to the counter 23 (step S166), and starts, from 0, the count operation of the counter 23. The CPU 10 reads out the count value of the counter 23, and stores it in the memory M12 (step S167). The CPU 10 reads out, from the memory M2, the number N2 of revolutions in plate cylinder/blanket cylinder pre-inking (step S168). The CPU 10 repeats the processing operations in steps S167 to S169 until the count value of the counter 23 reaches the number N2 of revolutions in plate cylinder/blanket cylinder pre-inking (YES in step S169).

As a result, the ink in the downstream roller subgroup 6B is supplied to the printing plate 7' mounted on the plate cylinder 8, and the blanket cylinder 9 (FIG. 5H). In this case, only ink of the relatively thin ink film thickness distribution MeB in the downstream roller subgroup 6B is supplied to the printing plate 7' and blanket cylinder 9, preventing the ink film thickness distribution on the printing plate 7' and blanket cylinder 9 from becoming excessively thick.

[Printing of Next Job (Printing Start Step)] [Coupling of Ink Roller Group]

Figure 8H:
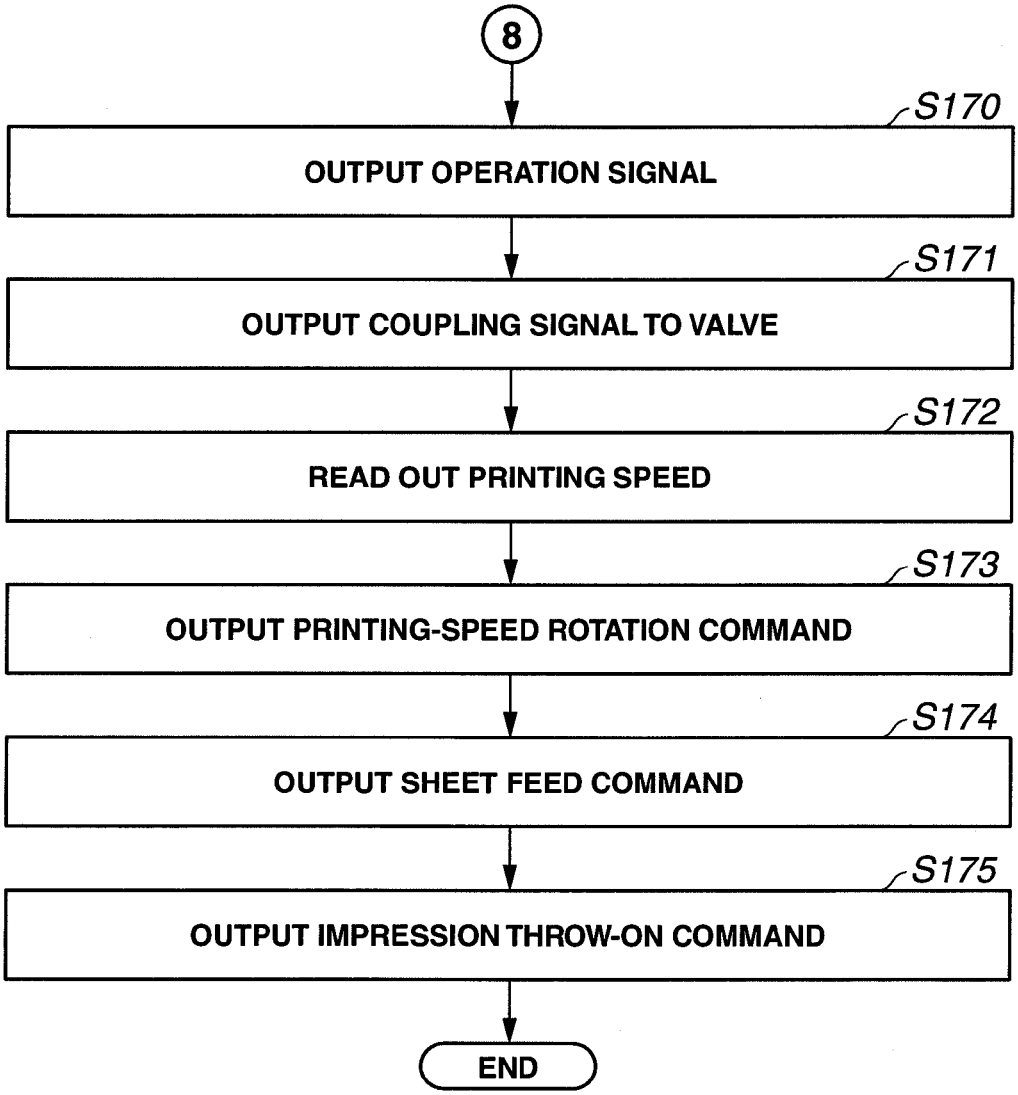

If the count value of the counter 23 reaches the number N2 of revolutions in plate cylinder/blanket cylinder pre-inking (YES in step S169), the CPU 10 outputs an operation signal to the ink ductor device 24 to start the ink feed operation of the ink ductor roller 5 (FIG. 8H: step S170).

The CPU 10 outputs a coupling signal to the valve 26 (step S171) to couple the upstream roller subgroup 6A and downstream roller subgroup 6B (see FIG. 2), and return them to the single ink roller group 6 (FIG. 5I).

[Start of Printing]

The CPU 10 reads out the printing speed Vp from the memory M5 (step S172). The CPU 10 outputs a printing-speed rotation command to the drive motor driver 19 via the D/A converter 21 (step S173), and sets the printing speed Vp as the speed of the printing press. The CPU 10 outputs a sheet feed command to the sheet feeder 30 (step S174) to start sheet feed to the printing press. The CPU 10 outputs an impression throw-on command (plate cylinder & blanket cylinder throw-on command) (step S175) to throw on the blanket cylinder 9 even on the impression cylinder 50. That is, the impression throw-on state in which the plate cylinder 8, blanket cylinder 9, and impression cylinder 50 contact each other is set (see FIG. 2). Then, printing of the next job starts using the printing plate 7'.

In this case, an ink film thickness distribution in printing of the next job (ink film thickness distribution in final printing) is formed during printing. At this time, the ink film thickness distribution MeB' in the downstream roller subgroup 6B and on the plate cylinder 8 and blanket cylinder 9 has become thin. Therefore, ink flows fast from the upstream side to the downstream side, quickly forming the ink film thickness distribution Mf (FIG. 5J) during final printing in the ink roller group 6 and on the plate cylinder 8 and blanket cylinder 9.

In this manner, the embodiment prevents the ink film thickness distribution formed on the plate cylinder 8 and blanket cylinder 9 from becoming excessively thick. Ink flows fast from the upstream side to the downstream side, quickly forming an ink film thickness distribution during final printing in the ink roller group 6 and on the plate cylinder 8 and blanket cylinder 9. After the printing plate 7' is replaced and printing of the next job starts, a normal printing product can be obtained in a short time.

[Ink Fountain Roller Control Apparatus]

Figure 9:
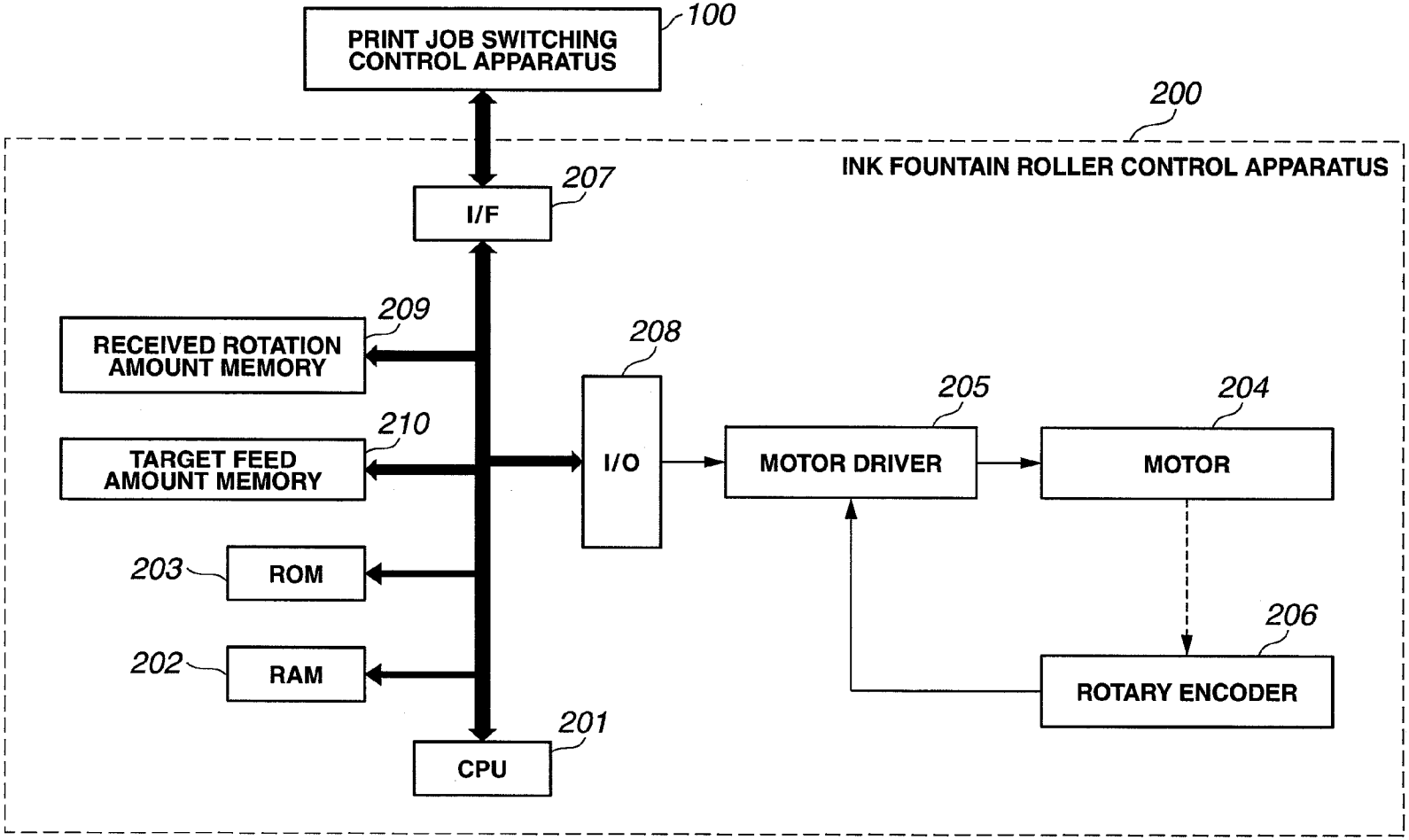
FIG. 9 is a block diagram showing an ink fountain roller control apparatus connected to the print job switching control apparatus shown in FIG. 1.

As shown in FIG. 9, the ink fountain roller control apparatus 200 includes a CPU 201, a RAM 202, a ROM 203, an ink fountain roller drive motor 204, an ink fountain roller drive motor driver 205, an ink fountain roller drive motor rotary encoder 206, input/output interfaces (I/O I/Fs) 207 and 208, and memories 209 and 210. The ink fountain roller control apparatus 200 is connected to the print job switching control apparatus 100 via the interface 207. The memory 209 stores a received rotation amount of the ink fountain roller. The memory 210 stores the target feed amount of the ink fountain roller.

Figure 10:
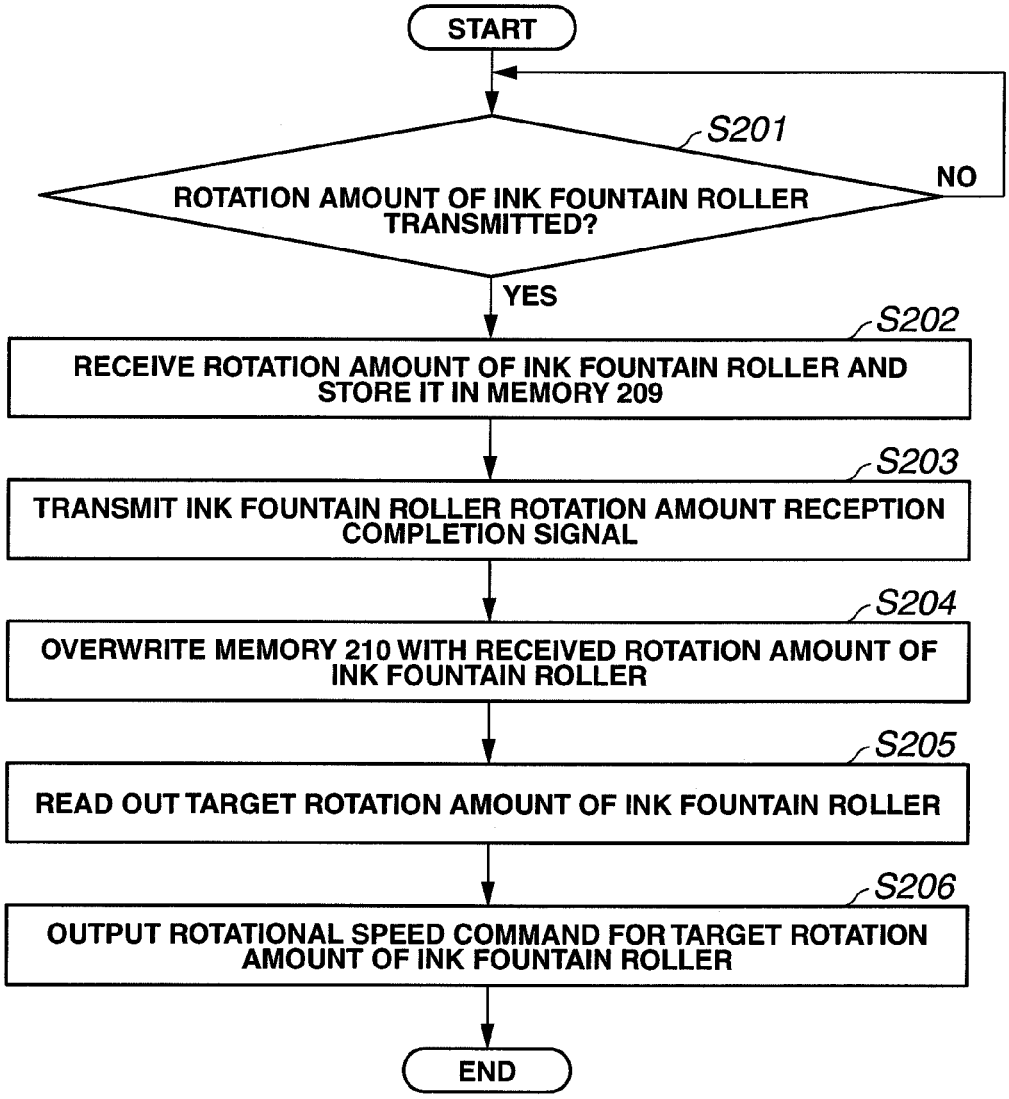
FIG. 10 is a flowchart showing the processing operation of the ink fountain roller control apparatus shown in FIG. 9.

If the print job switching control apparatus 100 has transmitted the rotation amount of the ink fountain roller (FIG. 10: YES in step S201), the CPU 201 stores the received rotation amount in the memory 209 (step S202). The CPU 201 then transmits an ink fountain roller rotation amount reception completion signal to the print job switching control apparatus 100 (step S203). The CPU 201 stores the received rotation amount of the ink fountain roller as the target feed amount (target rotation amount) of the ink fountain roller in the memory 210 (step S204). The CPU 201 reads out the target rotation amount from the memory 210 (step S205), sends it to the motor driver 205, and adjusts the rotation amount of the ink fountain roller drive motor 204 to coincide with the target rotation amount (step S206).

[Ink Fountain Key Control Apparatus]

Figure 11:
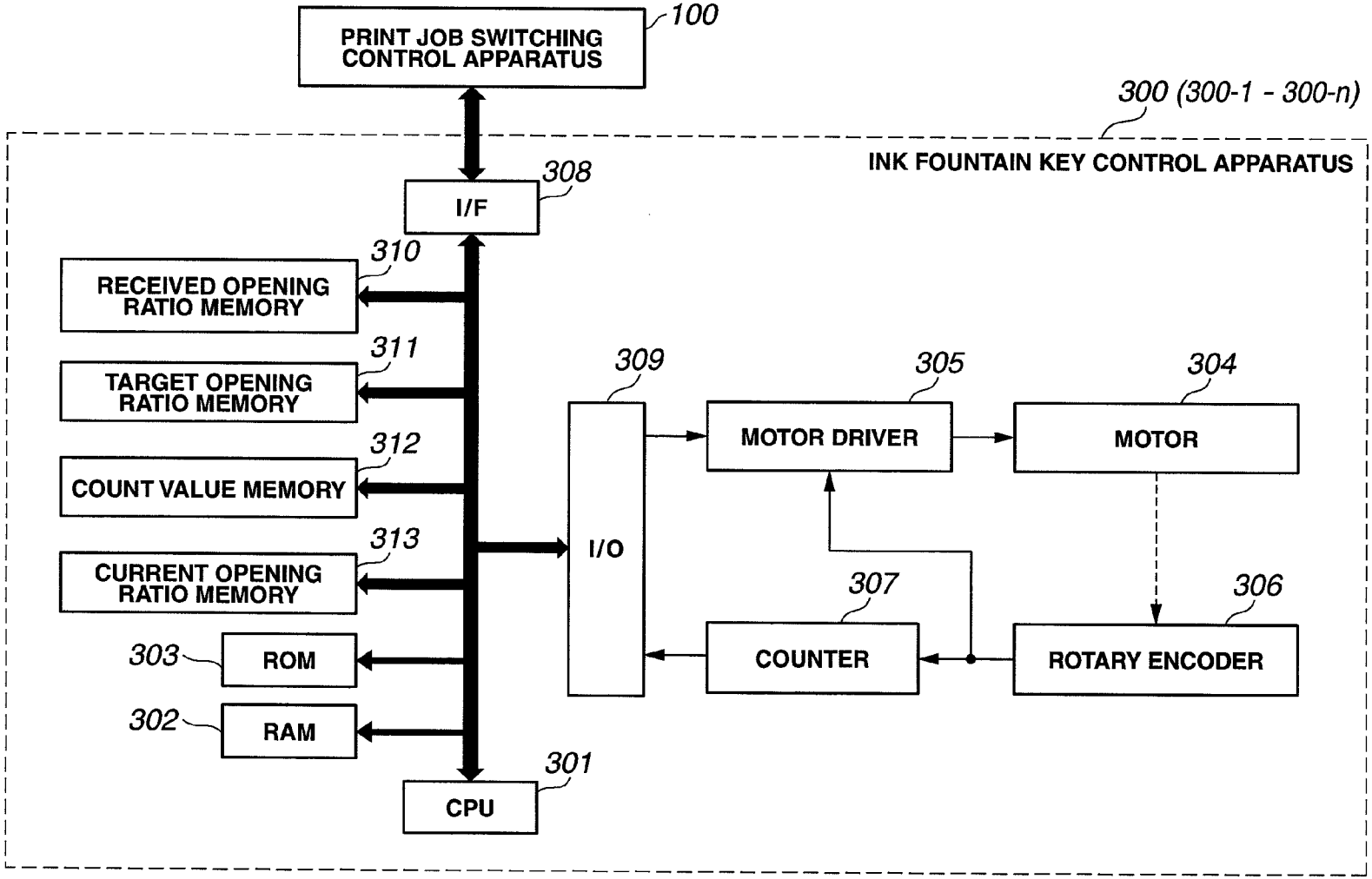
FIG. 11 is a block diagram showing an ink fountain key control apparatus connected to the print job switching control apparatus shown in FIG. 1.

As shown in FIG. 11, the ink fountain key control apparatus 300 includes a CPU 301, a RAM 302, a ROM 303, an ink fountain key drive motor 304, an ink fountain key drive motor driver 305, an ink fountain key drive motor rotary encoder 306, a counter 307, input/output interfaces (I/O I/Fs) 308 and 309, and memories 310 to 313. The ink fountain key control apparatus 300 is connected to the print job switching control apparatus 100 via the interface 308. The memory 310 stores a received opening ratio of the ink fountain key. The memory 311 stores the target opening ratio of the ink fountain key. The memory 312 stores the count value of the counter 307. The memory 313 stores the current opening ratio of the ink fountain key.

Figure 12A:
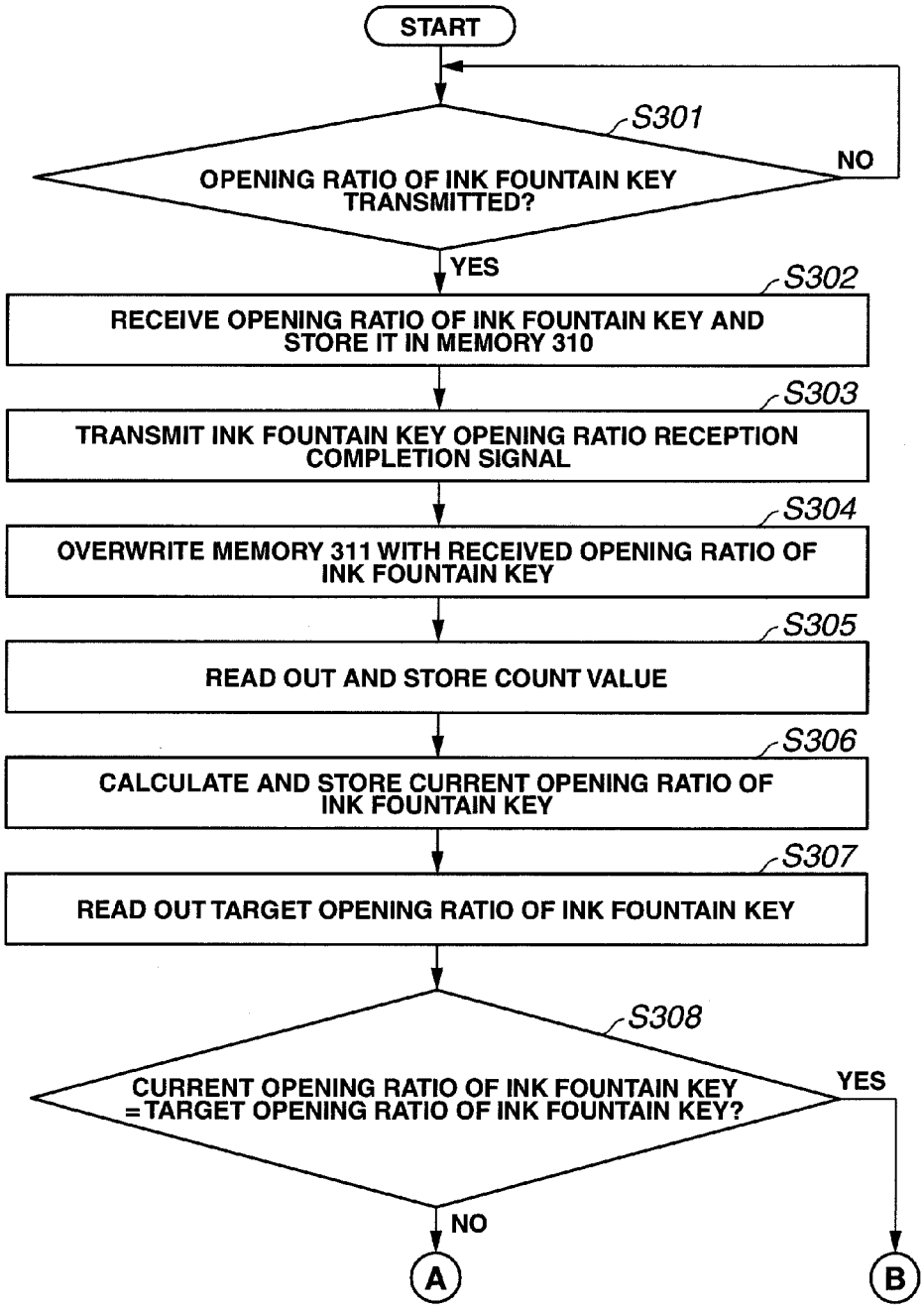
FIGS. 12A and 12B are flowcharts showing the processing operation of the ink fountain key control apparatus shown in FIG. 10.

If the print job switching control apparatus 100 has transmitted the opening ratio of the ink fountain roller (FIG. 12A: YES in step S301), the CPU 301 stores the received opening ratio in the memory 310 (step S302). The CPU 201 then transmits an ink fountain key opening ratio reception completion signal to the print job switching control apparatus 100 (step S303). The CPU 201 stores the received opening ratio of the ink fountain key as a target opening ratio in the memory 311 (step S304).

Figure 12B:
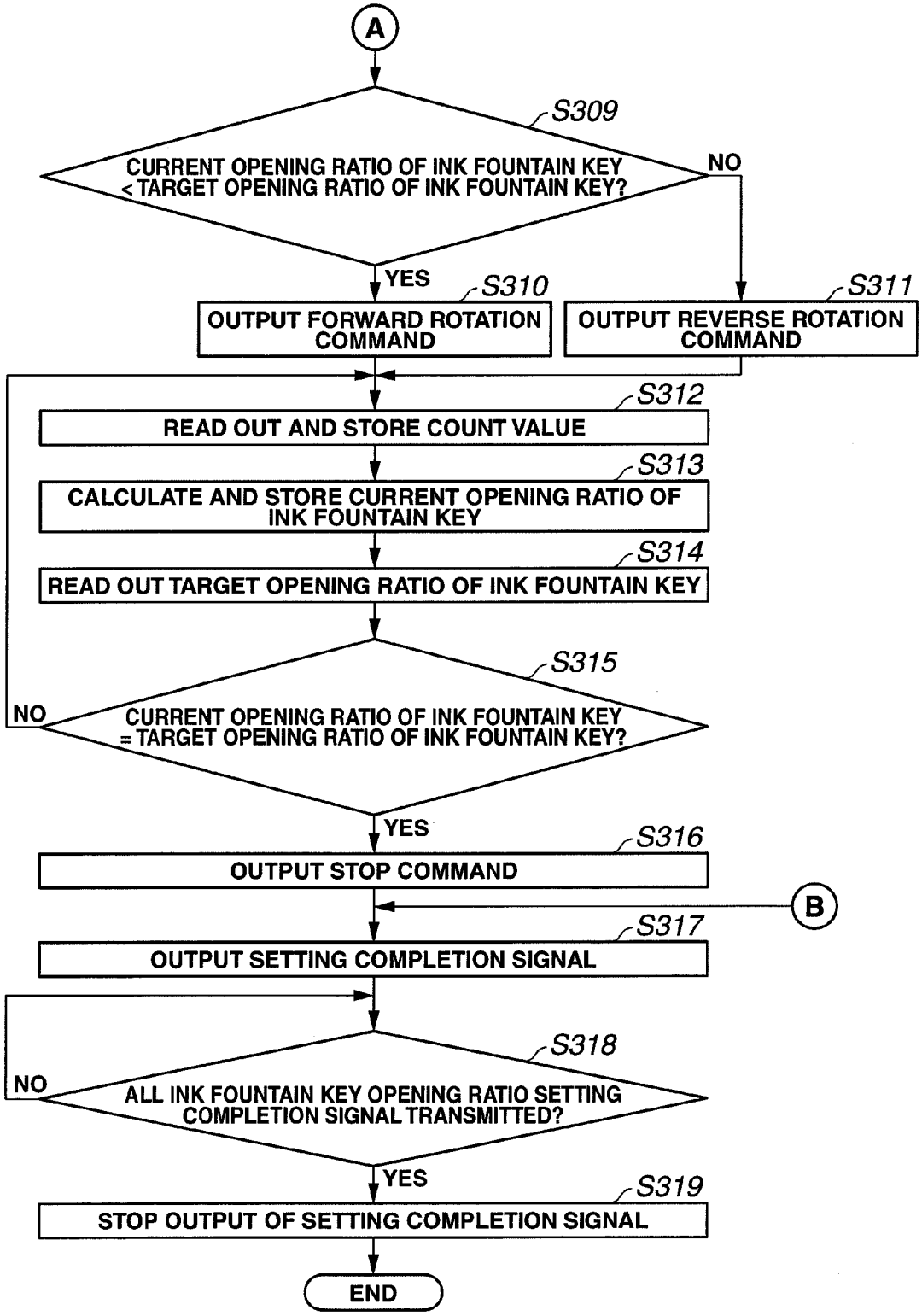

The CPU 301 reads the count value of the counter 307 and stores it in the memory 312 (step S305). The CPU 301 obtains the current opening ratio of the ink fountain key from the read count value of the counter 307, and stores it in the memory 313 (step S306). The CPU 301 reads out the target opening ratio of the ink fountain key from the memory 311 (step S307). If the current opening ratio of the ink fountain key is equal to the target opening ratio (YES in step S308), the process directly advances to step S317 (FIG. 12B). The CPU 301 outputs an ink fountain key opening ratio setting completion signal to the print job switching control apparatus 100.

If the current opening ratio of the ink fountain key is different from the target opening ratio (NO in step S308), the CPU 301 drives the ink fountain key drive motor 304 until the current opening ratio of the ink fountain key becomes equal to the target opening ratio (FIG. 12B: steps S309 to S316). After that, the CPU 301 outputs an ink fountain key opening ratio setting completion signal to the print job switching control apparatus 100 (step S317).

More specifically, if the current opening ratio of the ink fountain key is lower than the target opening ratio (YES in step S309), the CPU 301 sends a forward rotation command to the motor driver 305 (step S310). The CPU 301 reads out the count value from the counter 307 (step S312), and calculates the current opening ratio of the ink fountain key from the count value (step S313). The CPU 301 reads out the target opening ratio of the ink fountain key from the memory 311 (step S314). The CPU 301 repeats the processing operations in steps S312 to S315 until the current opening ratio of the ink fountain key coincides with the target opening ratio of the ink fountain key (YES in step S315).

If the current opening ratio of the ink fountain key is higher than the target opening ratio (NO in step S309), the CPU 301 sends a reverse rotation command to the motor driver 305 (step S311). The CPU 301 reads out the count value from the counter 307 (step S312), and calculates the current opening ratio of the ink fountain key from the count value (step S313). The CPU 301 reads out the target opening ratio of the ink fountain key from the memory 311 (step S314). The CPU 301 repeats the processing operations in steps S312 to S315 until the current opening ratio of the ink fountain key coincides with the target opening ratio of the ink fountain key (YES in step S315).

If the current opening ratio of the ink fountain key coincides with the target opening ratio of the ink fountain key in step S315 (YES in step S315), the CPU 301 outputs a stop command to the motor driver 305 (step S316), and outputs an ink fountain key opening ratio setting completion signal to the print job switching control apparatus 100 (step S317).

After outputting the ink fountain key opening ratio setting completion signal to the print job switching control apparatus 100 (step S317), the CPU 301 stops the output of the ink fountain key opening ratio setting completion signal to the print job switching control apparatus 100 (step S319) upon receiving an all ink fountain key opening ratio setting completion signal from the print job switching control apparatus 100 (YES in step S318).

In the above-described embodiment, the ink roller group 6 is divided into the two, upstream roller subgroup 6A and downstream roller subgroup 6B. However, the ink roller group 6 may be divided into a larger number of subgroups such as three or four. In this case, it suffices to throw on the most downstream roller subgroup out of the divided roller subgroups, and the plate cylinder on which a printing plate to be used for printing of the next job is mounted.

Formation of an ink film thickness distribution corresponding to an image on a printing plate to be used for printing of the next job in an ink roller group before dividing the ink roller group into a plurality of roller subgroups is not limited to the method described in the embodiment. For example, the ink roller group in the ink apparatus is divided into two, upstream and downstream roller subgroups, and ink in the upstream roller subgroup is scraped. Then, the upstream and downstream roller subgroups are coupled and rotated by a predetermined number of times to level ink remaining in the downstream roller subgroup so that the film thickness becomes uniform in the coupled ink roller group, thereby forming a reference ink film thickness. After that, the opening ratios of the respective ink fountain keys are set to values corresponding to an image on a printing plate to be used for printing of the next job. The ink feed operation is performed by a predetermined number of times, and an ink film thickness corresponding to the image in the next job is superposed on the reference ink film thickness. An ink film thickness distribution corresponding to an image on a printing plate to be used for printing of the next job may be formed in this manner, or formed by another method.

In the above-described embodiment, the ink roller group 6 is divided and coupled using the swing arm 40. However, the mechanism of dividing and coupling the ink roller group 6 is not limited to the mechanism using the swing arm.

Figure 13:
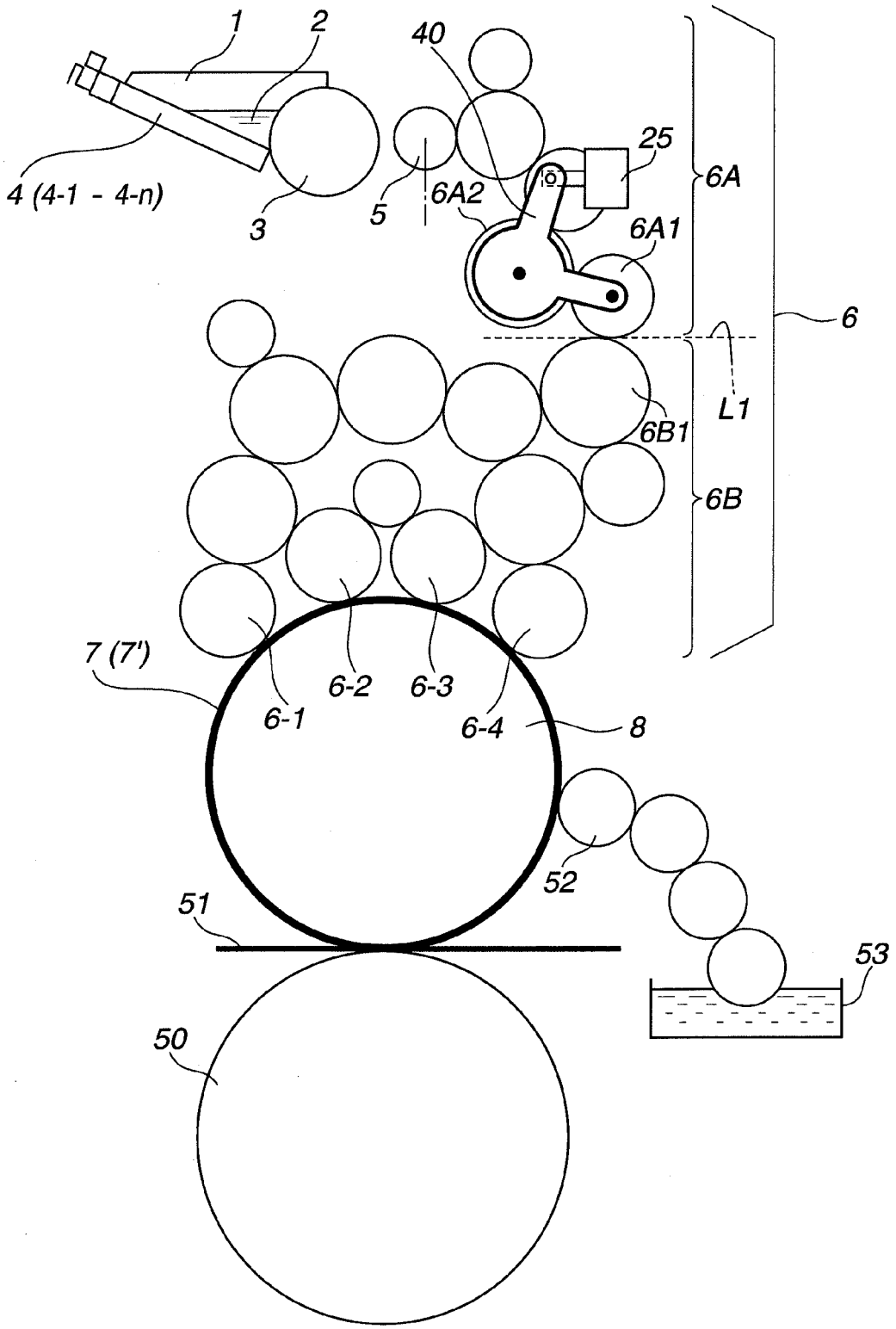
FIG. 13 is a view showing an example in which ink supplied to a printing plate mounted on the plate cylinder is directly transferred to a printing sheet without the mediacy of the blanket cylinder.

The above-described embodiment has explained an example in which ink supplied to the printing plate 7 (7') mounted on the plate cylinder 8 is transferred to the printing sheet 51 via the blanket cylinder 9. However, the present invention is similarly applicable to an example (see FIG. 13) in which ink supplied to the printing plate 7 (7') mounted on the plate cylinder 8 is directly transferred to the printing sheet 51 without the mediacy of the blanket cylinder 9. Even in this case, the same effects as those described above can be obtained.

As described above, according to the embodiment, an ink film thickness distribution corresponding to an image on a printing plate to be used for printing of the next job is formed in the ink roller group. The ink roller group in which the ink film thickness distribution corresponding to the image on the printing plate to be used for printing of the next job is formed is divided into a plurality of roller subgroups. After or before the division, at least the most downstream roller subgroup out of the plurality of roller subgroups, and the plate cylinder on which the printing plate to be used for printing of the next job is mounted are thrown on. That is, after division into a plurality of roller subgroups, at least the most downstream roller subgroup out of the divided roller subgroups, and the plate cylinder are thrown on. Alternately, after at least the most downstream roller subgroup out of a plurality of roller subgroups, and the plate cylinder are thrown on, the ink roller group is divided into a plurality of roller subgroups. The plate cylinder and the divided roller subgroup, which are thrown on, are rotated by a predetermined number of times, and ink in the roller subgroup is supplied to the printing plate mounted on the plate cylinder.

Although the ink roller group is divided into a plurality of roller subgroups, the number of roller subgroups is arbitrary if it is two or more. For example, in the present invention, when the ink roller group is dividable into two roller subgroups, it is divided into upstream and downstream roller subgroups. After or before the division, the downstream roller subgroup and the plate cylinder are thrown on. The plate cylinder and the divided downstream roller subgroup, which are thrown on, are rotated by a predetermined number of times, and ink in the downstream roller subgroup is supplied to the printing plate mounted on the plate cylinder. In this case, only ink of a relatively thin ink film thickness distribution in the downstream roller subgroup is supplied to the printing plate, preventing the ink film thickness distribution on the printing plate from becoming excessively thick.

Note that ink supplied to the printing plate mounted on the plate cylinder can be directly transferred to a member to be printed, without the mediacy of the blanket cylinder. However, when the ink is transferred via the blanket cylinder, at least the most downstream roller subgroup out of a plurality of roller subgroups, and the plate cylinder on which a printing plate to be used for printing of the next job are thrown on in the throw-on step after or before division in the roller group division step. In addition, the plate cylinder and blanket cylinder are thrown on. In the ink supply step, the plate cylinder, the roller subgroup divided in the roller group division step, and the blanket cylinder, which are thrown on in the throw-on step, are rotated by a predetermined number of times, thereby supplying ink in the roller subgroup to the printing plate mounted on the plate cylinder and the blanket cylinder. In the present invention, for example, when the ink roller group is divided into upstream and downstream roller subgroups, only ink of a relatively thin ink film thickness distribution in the downstream roller subgroup is supplied to the printing plate and blanket cylinder, preventing the ink film thickness distribution on the printing plate and blanket cylinder from becoming excessively thick.

Further, the embodiment includes the printing start step of, after supplying ink in the ink supply step, coupling the plurality of divided roller subgroups to return them to the single ink roller group, and starting printing of the next job by using a printing plate mounted on the plate cylinder. For example, when the ink roller group is divided into upstream and downstream roller subgroups, ink in the downstream roller subgroup is supplied to form an ink film thickness distribution on the plate cylinder (or the plate cylinder and blanket cylinder). Then, the upstream and downstream roller subgroups are coupled and returned to the single roller group, and printing of the next job starts. In this case, an ink film thickness distribution in printing of the next job (ink film thickness distribution in final printing) is formed during printing. At this time, an ink film thickness distribution in the downstream roller subgroup and on the plate cylinder (or the plate cylinder and blanket cylinder) has become thin. Thus, ink flows fast from the upstream side to the downstream side, quickly forming an ink film thickness distribution during final printing in the ink roller group and on the plate cylinder (or the plate cylinder and blanket cylinder).

What is claimed is:

1. An ink supply method in an ink supply apparatus including an ink fountain storing an ink, a plurality of ink fountain keys arranged in the ink fountain, an ink fountain roller to which the ink is supplied from the ink fountain in accordance with opening ratios of the plurality of ink fountain keys, an ink ductor roller to which the ink is transferred from the ink fountain roller by an ink feed operation, and an ink roller group to which the ink transferred to the ink ductor roller is supplied, comprising the steps of:

forming, in the ink roller group, an ink film thickness distribution corresponding to an image on a printing plate for printing of a next job;

dividing, into a plurality of roller subgroups, the ink roller group in which the ink film thickness distribution to be used for printing of the next job is formed;

performing, after or before division, a throw-on operation for at least a most downstream roller subgroup out of the plurality of roller subgroups, and a plate cylinder on which the printing plate to be used for printing of the next job is mounted; and supplying ink in at least the most downstream roller subgroup to the printing plate mounted on the plate cylinder by rotating by a predetermined number of times the plate cylinder and at least the most downstream roller subgroup, which are thrown on.

2. A method according to claim 1, wherein the step of performing a throw-on operation includes the step of performing a throw-on operation for the plate cylinder, and a blanket cylinder on which ink supplied to the printing plate mounted on the plate cylinder is transferred to a member to be printed, and the step of supplying ink includes the step of supplying ink in at least the most downstream roller subgroup to the printing plate mounted on the plate cylinder, and the blanket cylinder by rotating by a predetermined number of times the plate cylinder, at least the most downstream roller subgroup, and the blanket cylinder, which are thrown on.

3. A method according to claim 1, further comprising the steps of:

coupling the plurality of divided roller subgroups to return the plurality of divided roller subgroups to the single ink roller group after ink supply; and starting printing of the next job using a printing plate mounted on the plate cylinder.

* * * * *